US008936895B2

(12) United States Patent
Sugiura

(10) Patent No.: US 8,936,895 B2
(45) Date of Patent: Jan. 20, 2015

(54) TONER, DEVELOPER, AND IMAGE FORMING METHOD

(75) Inventor: Hideki Sugiura, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/881,776

(22) PCT Filed: Oct. 7, 2011

(86) PCT No.: PCT/JP2011/073746

§ 371 (c)(1),
(2), (4) Date: Apr. 26, 2013

(87) PCT Pub. No.: WO2012/056910

PCT Pub. Date: May 3, 2012

(65) Prior Publication Data

US 2013/0323634 A1 Dec. 5, 2013

(30) Foreign Application Priority Data

Oct. 28, 2010 (JP) ..... 2010-242331
Aug. 29, 2011 (JP) ..... 2011-186494

(51) Int. Cl.

| | |
|---|---|
| ***G03G 9/093*** | (2006.01) |
| ***G03G 9/08*** | (2006.01) |
| ***G03G 9/087*** | (2006.01) |
| ***G03G 13/20*** | (2006.01) |

(52) U.S. Cl.

CPC ..... *G03G 9/0821* (2013.01); *G03G 9/0819* (2013.01); *G03G 9/0827* (2013.01); *G03G 9/08755* (2013.01); *G03G 9/08795* (2013.01); *G03G 9/08797* (2013.01); *G03G 9/09321* (2013.01); *G03G 9/09328* (2013.01); *G03G 9/09371* (2013.01); *G03G 9/09392* (2013.01); *G03G 13/20* (2013.01)

USPC ..... 430/110.2; 430/109.4; 430/110.1; 430/110.3; 430/110.4; 430/123.5

(58) Field of Classification Search

USPC ..... 430/109.4, 110.1, 110.2, 110.3, 110.4, 430/123.5

See application file for complete search history.

(56) References Cited

U.S. PATENT DOCUMENTS

| | | | |
|---|---|---|---|
| 7,166,403 | B2 | 1/2007 | Ichikawa et al. |
| 7,261,989 | B2 | 8/2007 | Sugiura et al. |

(Continued)

FOREIGN PATENT DOCUMENTS

| | | |
|---|---|---|
| JP | 2006-267231 | 10/2006 |
| JP | 2009-020269 | 1/2009 |

(Continued)

OTHER PUBLICATIONS

Translation of JP 2010-175933 published Aug. 2010.*

(Continued)

*Primary Examiner* — Peter Vajda

(74) *Attorney, Agent, or Firm* — Oblon, Spivak, McClelland, Maier & Neustadt, L.L.P.

(57) ABSTRACT

To provide a toner, which contains: base particles each having a core-shell structure, where a core of the base particle contains crystalline polyester, non-crystalline polyester, a colorant, and a releasing agent, and a shell of the base particle contain a resin, wherein the toner has thermal hardness of 0.5 to 1.8, wherein the toner has a softening index of 80° C. to 95° C., and wherein the toner has thermal retentiveness of 30° C. to 50° C.

10 Claims, 5 Drawing Sheets

(56) References Cited

U.S. PATENT DOCUMENTS

| | | | |
|---|---|---|---|
| 7,318,989 | B2 | 1/2008 | Kotsugai et al. |
| 7,374,851 | B2 | 5/2008 | Nakayama et al. |
| 7,405,000 | B2 | 7/2008 | Takikawa et al. |
| 7,455,942 | B2 | 11/2008 | Nagatomo et al. |
| 7,664,439 | B2 | 2/2010 | Sugiura |
| 7,745,084 | B2 | 6/2010 | Sugiura et al. |
| 7,759,036 | B2 | 7/2010 | Utsumi et al. |
| 8,007,976 | B2 | 8/2011 | Sugiura et al. |
| 8,043,780 | B2 | 10/2011 | Sugiura et al. |
| 2006/0024604 | A1 | 2/2006 | Sugiura et al. |
| 2006/0216628 | A1 | 9/2006 | Nakamura et al. |
| 2007/0059063 | A1 | 3/2007 | Nakayama et al. |
| 2007/0140748 | A1 | 6/2007 | Sugiura |
| 2008/0014527 | A1 | 1/2008 | Kotsugai et al. |
| 2008/0268366 | A1 | 10/2008 | Nakayama et al. |
| 2008/0305423 | A1 | 12/2008 | Sugiura et al. |
| 2009/0123186 | A1 | 5/2009 | Sugiura et al. |
| 2011/0003244 | A1 | 1/2011 | Inoue et al. |
| 2011/0097659 | A1 | 4/2011 | Sugiura et al. |
| 2011/0281209 | A1 | 11/2011 | Sugiura et al. |

FOREIGN PATENT DOCUMENTS

| | | | | |
|---|---|---|---|---|
| JP | 2010-175933 | * | 8/2010 | ..... G03G 9/08 |
| JP | 2011-257738 | | 12/2011 | |

OTHER PUBLICATIONS

International Search Report Issued Nov. 22, 2011 in PCT/JP11/73746 Filed on Oct. 7, 2011.

* cited by examiner

TONER, DEVELOPER, AND IMAGE FORMING METHOD

TECHNICAL FIELD

The present invention relates to a toner, a developer, and an image forming method.

BACKGROUND ART

In an image forming apparatus such as an electrophotographic device, and an electrostatic recording device, an image is formed by developing a latent electrostatic image formed on a photoconductor with a toner to form a toner image, and transferring the toner image to a recording medium such as paper, followed by fixing the toner image thereon with heat. For forming a full color image, developing is generally performed using toners of 4 colors, i.e. black, yellow, magenta, and cyan. In this case, a toner image formed of a toner of each color is transferred to a recording medium to superimpose all the toner images, and then fixed thereon with heat.

In the course of the preparation of full-color images, there is a problem that heat resistance storage stability of a toner lowers as low temperature fixing ability of the toner is improved.

To counter this problem, PTL1 discloses a core-shell structured toner containing a releasing agent, a colorant, a binder resin and filler, as a toner for developing latent electrostatic images. This toner has the ½ outflow temperature of 60° C. to 100° C. as measured by a flow tester, and the shell of the toner contains a thermoplastic resin.

The disclosed toner however has a problem that low temperature fixing ability of the toner, inhibition of toner spent, and hot offset resistance of the toner cannot be achieved at the same time in high temperature and high humidity environments.

CITATION LIST

Patent Literature

PTL 1 Japanese Patent Application Laid-Open (JP-A) No. 2006-267231

SUMMARY OF INVENTION

Technical Problem

The present invention aims to provide a toner having excellent low temperature fixing ability, excellent inhibition of toner spent, and excellent hot offset resistance in high temperature and high humidity environments, as well as providing a developer containing the toner and a carrier, and an image forming method using the developer.

Solution to Problem

The means for solving the aforementioned problems are as follows:

<1> A toner containing:

base particles each having a core-shell structure, where a core of the base particle contains crystalline polyester, non-crystalline polyester, a colorant, and a releasing agent, and a shell of the base particle contain a resin, wherein the toner has thermal hardness of 0.5 to 1.8, wherein the toner has a softening index of 80° C. to 95° C., and wherein the toner has thermal retentiveness of 30° C. to 50° C.

<2> The toner according to <1>, wherein the resin in the shell is a vinyl resin, or polyester.

<3> The toner according to any of <1> or <2>, wherein the shell has a thickness of 0.01 μm to 2 μm.

<4> The toner according to any one of <1> to <3>, wherein the core further contains urea-modified polyester.

<5> The toner according to <4>, wherein the base particles are base particles obtained by the method containing:

emulsifying or dispersing, in an aqueous medium including particles containing the resin, a liquid prepared by dissolving or dispersing materials containing the crystalline polyester, the non-crystalline polyester, polyester prepolymer containing an isocyanate group, a compound containing an amino group, the colorant, and the releasing agent in an organic solvent; and removing the organic solvent.

<6> The toner according to any one of <1> to <5>, wherein the toner has an average circularity of 0.93 to 0.99.

<7> The toner according to any one of <1> to <6>, wherein the toner has a shape factor SF-1 of 100 to 150, and a shape factor SF-2 of 100 to 140.

<8> The toner according to any one of <1> to <7>, wherein the toner has a weight average particle diameter of 2 μm to 7 μm, and a ratio of 1.00 to 1.25, where the ratio is a ratio of the weight average particle diameter of the toner to an number average particle diameter of the toner.

<9> A developer, containing:

the toner as defined in any one of <1> to <8>; and a carrier.

<10> An image forming method for forming a full-color image with a tandem image forming apparatus, the method containing:

forming a plurality of latent electrostatic images on a plurality of latent electrostatic image bearing members, respectively;

developing the latent electrostatic images formed on the latent electrostatic image bearing members with the developer as defined in <9> to form toner images, respectively;

primary, successively transferring the toner images formed on the latent electrostatic image bearing members onto an intermediate transfer member to form a full-color toner image;

secondary transferring the full-color toner image formed on the intermediate transfer member onto a recording medium; and pressing and heating the full-color toner image transferred on the recording medium at bearing of $1\times10^5$ Pa to $3\times10^7$ Pa for 0.03 seconds to 0.4 seconds, to fix the full-color toner image on the recording medium, wherein the method employs a system speed of 0.2 m/s to 3 m/s.

Advantageous Effects of Invention

The present invention can provide a toner having excellent low temperature fixing ability, excellent inhibition of toner spent, and excellent hot offset resistance in high temperature and high humidity environments, as well as providing a developer containing the toner and a carrier, and an image forming method using the developer.

DESCRIPTION OF EMBODIMENTS (Toner)

The toner of the present invention contains base particles each having a core-shell structure, where the core contains crystalline polyester, non-crystalline polyester, a colorant, and a releasing agent, and the shell contains a resin.

Conventionally, it has been difficult to achieve low temperature fixing ability of a toner in high temperature and high humidity environments, inhibition of toner spent, and hot offset resistance of the toner at the same time.

In the present invention the functions of the core and the functions of the shell are highly balanced as a functional separation toner where the core and the shell each have different functions. As a result, it is possible to achieve low temperature fixing ability, inhibition of toner spent, and hot offset resistance at the same time in high temperature high humidity environments.

Specifically, the thermal hardness St of the toner is defined, where the thermal hardness St is a parameter for controlling the function of the shell for bearing stress during developing, and preventing the substances contained in the core from bleeding out on the surface of the toner particle. The thermal hardness St reflects a thickness of the shell, properties of the resin contained in the shell, and the like.

Moreover, the softening index Ct of the toner is specified, where the softening index Ct is a parameter for controlling the function of the core for preventing the substances contained in the core from bleeding out on the surface of the toner particle. The softening index Ct reflects properties of the crystalline polyester contained in the core, and the like.

Furthermore, the thermal retentiveness Ht of the toner is specified, where the thermal retentiveness Ht is a parameter for controlling a temperature difference between the temperature at which the core starts fusing and the temperature at which the core completely fuses. The thermal retentiveness Ht reflects properties of the non-crystalline polyester contained in the core, and the like.

The thermal hardness St of the toner is 0.5 to 1.8, preferably 1.0 to 1.7. When the thermal hardness St of the toner is lower than 0.5, the inhibition of the toner spent may not be sufficient in high temperature high humidity environments. When the thermal hardness St of the toner is higher than 1.8, the toner may have insufficient low temperature fixing ability in high temperature high humidity environments.

Figure 1:
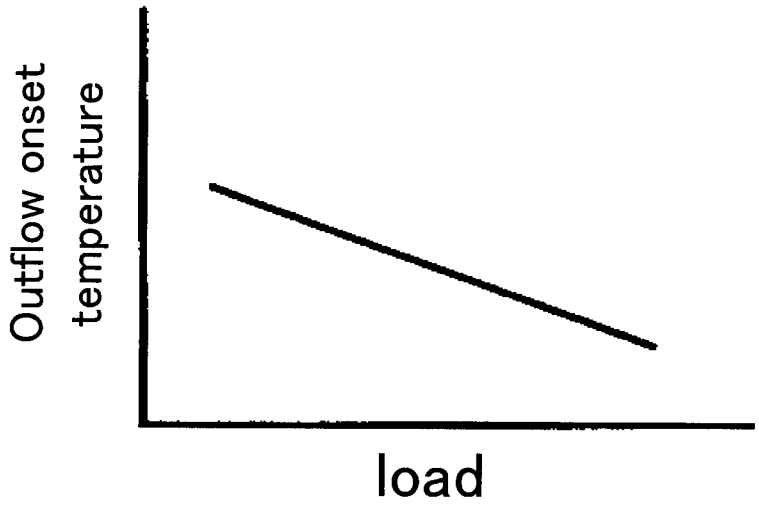
FIG. 1 is a diagram for explaining thermal hardness of a toner.

Note that, the thermal hardness St is a value obtained by measuring an outflow onset temperature of the toner with the load of 2 kgf to 25 kgf by means of a flow tester CFT-500D (manufactured by Shimadzu Corporation), plotting the load on the transverse axis and the outflow onset temperature on the ordinate in a graph, and calculating the product of the gradient of the plotted line and −1 (see FIG. 1). Specifically, the thermal hardness St indicates the load dependency of the easiness of fusing the toner. It is considered that the structure of the shell is broken as the load of 25 kgf is applied. In the case where the thermal hardness St is small, therefore, the outflow onset temperature of the toner is not high. Namely, the toner easily fuses, as the structure of the shell is broken with the application of the small load. Conversely, in the case where the thermal hardness St of the toner is large, the outflow onset temperature is high as the small load is applied. Namely, the toner does not easily fuse, as the structure of the shell is not easily broken with the application of the small load.

The softening index Ct of the toner is 80° C. to 95° C., preferably 86° C. to 90° C. When the softening index Ct of the toner is lower than 80° C., the inhibition of the toner spent may not be sufficient in high temperature high humidity environments. When the softening index Ct of the toner is higher than 95° C., the toner may have insufficient low temperature fixing ability in high temperature high humidity environments.

Figure 2:
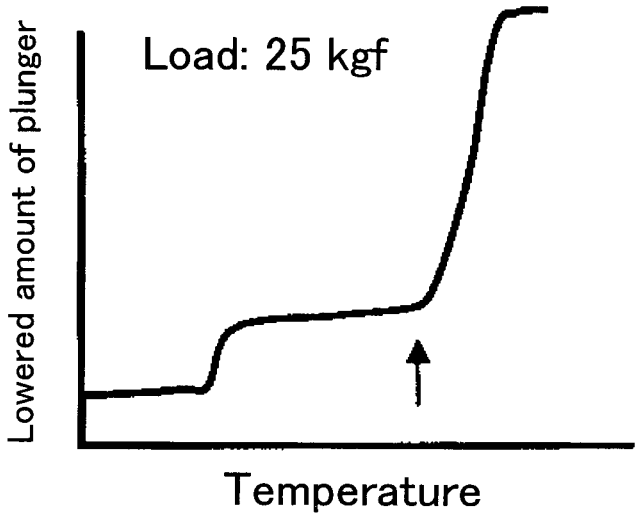
FIG. 2 is a diagram for explaining a softening index of a toner.

Note that, the softening index Ct is an outflow onset temperature of the toner as measured by a flow tester CFT-500D (manufactured by Shimadzu Corporation) with the load of 25 kgf (see FIG. 2). It is considered that the structure of the shell is broken with the application of the load of 25 kgf. Therefore, the softening index Ct of the toner indicates easiness of fusing the toner whose shell structure is broken (i.e., the core).

The thermal retentiveness Ht of the toner is 30° C. to 50° C., preferably 35° C. to 45° C.

When the thermal retentiveness Ht of the toner is lower than 30° C., the toner may have insufficient hot offset resistance in high temperature high humidity environments. When the thermal retentiveness Ht of the toner is higher than 50° C., the toner may have insufficient low temperature fixing ability in high temperature high humidity environments.

Figure 3:
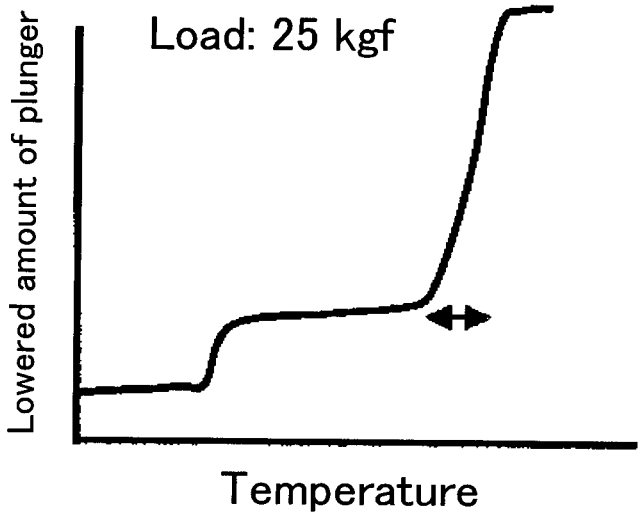
FIG. 3 is a diagram for explaining thermal retentiveness of a toner.

Note that, the thermal retentiveness Ht of the toner is a difference of the outflow endset temperature and outflow onset temperature of the toner as measured by a flow tester CFT-500D (manufactured by Shimadzu Corporation) with the load of 25 kgf (see FIG. 3). It is considered that the structure of the shell is broken with the application of the load of 25 kgf. Therefore, the thermal retentiveness Ht of the toner indicates the margin of the toner whose shell structure is broken (i.e., the core) with respect to the hot offset.

Figure 4A:
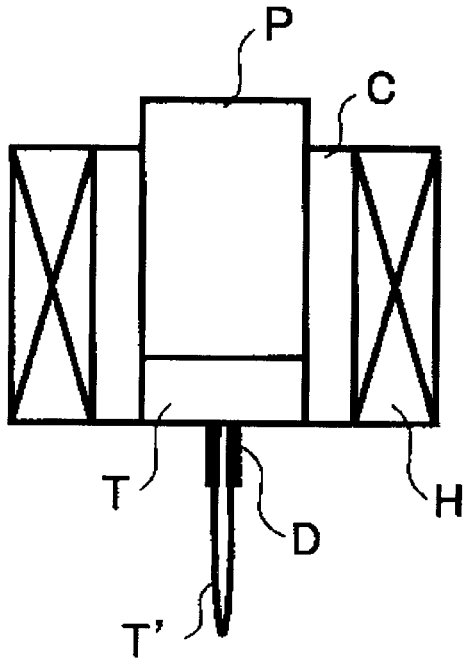
FIGS. 4A and 4B are diagrams for explaining measuring methods of thermal hardness, softening index, and thermal retentiveness of a toner.
Figure 4B:
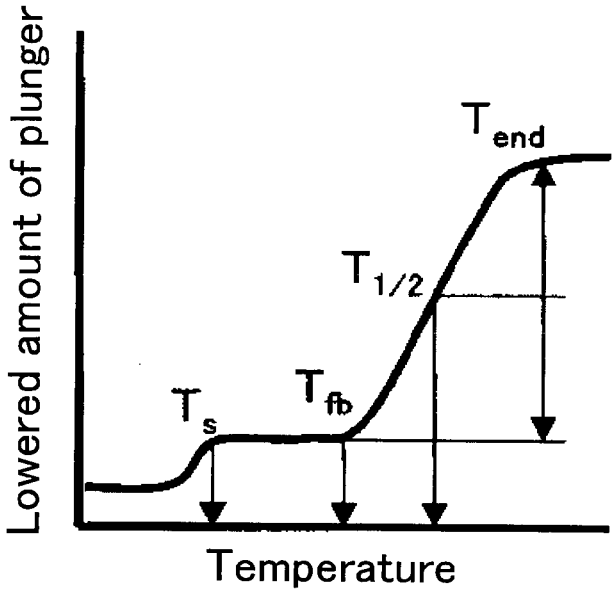

A flow tester CFT-500D (manufactured by Shimadzu Corporation) is, as illustrated in FIG. 4A, configured to house a tablet toner T, which has been prepared by compression molding the toner into a cylindrical shape, in a cylinder C, to preheat the tablet toner T to the temperature $T_s$ [° C.], and to heat a heating element H with applying a constant load with a plunger P, to thereby flow the fused toner T' from a die D. The flow tester measures, as illustrated in FIG. 4B, the lowered amount of the plunger P relative to the temperature of the heating element H. The flow tester CFT-500D (manufactured by Shimadzu Corporation) is generally used for measuring an outflow onset temperature T or temperature $T_{1/2}$ with a constant load. In the present invention, however, the thermal hardness St, softening index Ct, and thermal retentiveness Ht can be evaluated by measuring the outflow onset temperature $T_{fb}$ and the outflow endset temperature $T_{end}$ with varying the load to apply.

A thickness of the shell is preferably 0.01 μm to 2 μm, more preferably 0.4 μm to 1.5 μm. When the thickness of the shell is thinner than 0.01 μm, the resulting toner may not exhibit desirable inhibition of toner spent in high temperature and high humidity environments. When the thickness thereof is thicker than 2 μm, low temperature fixing ability of the resulting toner may be low in high temperature and high humidity environments.

Note that, the thickness of the shell can be measured with a transmission electron microscope, and is the average value calculated from the values of the thickness of the shells obtained by measuring randomly selected 10 toner particles.

The crystalline polyester can be synthesized by heating polycarboxylic acid and polyhydric alcohol to 180° C. to 230° C. in the presence of a catalyst, and removing the generated water or alcohol, optionally under the pressure, to thereby condensate the polycarboxylic acid and the polyhydric alcohol.

The catalyst is appropriately selected depending on the intended purpose without any restriction. Examples thereof include sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyl tin dichloride, dibutyl tin oxide, diphenyl tin oxide, zirconium tetrabutoxide, zirconium naphthenate, zirconium carbonate, zirconium acetate, zirconium stearate, zirconium octylate, germanium oxide, triphenyl phosphite, tris(2,4-di-t-butylphenyl)phosphite, ethyltriphenyl phosphonium bromide, triethyl amine, and triphenyl amine. These may be used independently, or in combination.

The polycarboxylic acid is appropriately selected depending on the intended purpose without any restriction. Examples thereof include: aliphatic dicarboxylic acid such as oxalic acid, succinic acid, glutaric acid, adipic acid, suberic acid, azelaic acid, sebacic acid, 1,9-nonane dicarboxylic acid, 1,10-decane dicarboxylic acid, 1,12-dodecane dicarboxylic acid, 1,14-tetradecane dicarboxylic acid, and 1,18-octadecane dicarboxylic acid; aromatic dicarboxylic acid such as phthalic acid, isophthalic acid, terephthalic acid, naphthalene-2,6-dicarboxylic acid, malonic acid, and mesaconic acid; and aromatic tricarboxylic acid such as 1,2,4-benzene tricarboxylic acid, 1,2,5-benzene tricarboxylic acid, and 1,2,4-naphthalene tricarboxylic acid. These may be used independently, or in combination.

Note that, anhydrides of the polycarboxylic acid, or lower alkyl esters of the polycarboxylic acid may be used instead of the polycarboxylic acid.

Moreover, the polycarboxylic acid may include dicarboxylic acid containing a sulfonic acid group, and dicarboxylic acid having a double bond.

The polyhydric alcohol is generally aliphatic alcohol, preferably aliphatic diol having a straight C7-C20 principle chain, and more preferably aliphatic diol having a straight C7-C14 principle chain. When the aliphatic diol has a branched chain structure, the resulting crystalline polyester has low crystallinity, so that the resulting crystalline polyester has a low melting point. When the number of carbon atoms in the principle chain of the aliphatic diol is smaller than 7, the resulting condensate with the aromatic dicarboxylic acid has a high melting point, which may result in poor low temperature fixing ability of the resulting toner. When the number of carbon atoms thereof is larger than 20, it is difficult to attain such the aliphatic diol.

The aliphatic diol is appropriately selected depending on the intended purpose without any restriction. Examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. These may be used independently, or in combination. Among them, 1,8-octanediol, 1,9-nonanediol, and 1,10-decanediol are particularly preferable, because they are readily available.

The aliphatic tri or higher polyhydric alcohol is appropriately selected depending on the intended purpose without any restriction. Examples thereof include glycerin, trimethylol ethane, trimethylol propane, and pentaerythritol. These may be used independently, or in combination.

An amount of the aliphatic diol in the polyhydric alcohol is generally 80 mol % to 100 mol %, preferably 90 mol % to 100 mol %. When the amount of the aliphatic diol in the polyhydric alcohol is less than 80 mol %, the crystallinity of the resulting crystalline polyester reduces, which lowers the melting point of the resulting crystalline polyester, so that the resulting toner using such the crystalline polyester may poor heat resistance storage stability, shelf stability of images, and low temperature fixing ability.

During the synthesis of the crystalline polyester, polycarboxylic acid or polyhydric alcohol may be optionally further added at the final stage of the synthesis for adjusting an acid value or hydroxyl value of the resulting crystalline polyester.

The polycarboxylic acid is appropriately selected depending on the intended purpose without any restriction. Examples thereof include: aromatic carboxylic acid such as terephthalic acid, isophthalic acid, phthalic anhydride, trimellitic anhydride, pyromellitic acid, and naphthalene dicarboxylic acid; aliphatic carboxylic acid such as maleic anhydride, fumaric acid, succinic acid, alkenyl succinic anhydride, and adipic acid; and alicyclic carboxylic acid such as cyclohexane dicarboxylic acid.

The polyhydric alcohol is appropriately selected depending on the intended purpose without any restriction. Examples thereof include: aliphatic diol such as ethylene glycol, diethylene glycol, triethylene glycol, propylene glycol, butanediol, hexanediol, neopentyl glycol, and glycerin; alicyclic diol such as cyclohexane diol, cyclohexane dimethanol, and hydrogenated bisphenol A; and aromatic diol such as an ethylene oxide adduct of bisphenol A, and a propylene oxide adduct of bisphenol A.

In the case where the polycarboxylic acid and the polyhydric alcohol are not dissolved or compatible to each other, a solvent may be added to aid them to be dissolved. Alternatively, the polycarboxylic acid (or the polyhydric alcohol) having low compatibility and the polyhydric alcohol (or the polycarboxylic acid) may be condensation polymerized in advance, and then the resultant may further subjected to a condensation reaction with the polycarboxylic acid (or the polyhydric alcohol) having high compatibility.

A melting point of the crystalline polyester is generally 50° C. to 100° C., preferably 55° C. to 90° C., and more preferably 60° C. to 85° C. When the melting point of the crystalline polyester is lower than 50° C., the resulting toner may have poor heat resistance storage stability. When the melting point thereof is higher than 100° C., the resulting toner may have poor low temperature fixing ability.

The melting point of the crystalline polyester can be measured by DSC.

The acid value of the crystalline polyester is generally 3 mgKOH/g to 30 mgKOH/g, preferably 6 mgKOH/g to 25 mgKOH/g, and more preferably 8 mgKOH/g to 20 mgKOH/g. When the acid value of the crystalline polyester is lower than 3 mgKOH/g, the resulting base particles may have insufficient stability, which may results in inefficient production of the toner. When the acid value thereof is higher than 30 mgKOH/g, the resulting toner has high moisture uptake so that it may be easily affected by the surrounding environment.

The acid value of the crystalline polyester can be measured in accordance with the method described in JIS K0070-1992.

The weight average molecular weight of the crystalline polyester resin is generally $6\times10^3$ to $3.5\times10^4$. When the weight average molecular weight thereof is smaller than $6\times10^3$, the resulting toner may be penetrated into a surface of a recording medium upon fixing the toner image transferred on the recording medium, which may results in fixation unevenness, or low strength of the resulting fixed image against bending. When the weight average molecular weight thereof is larger than $3.5\times10^4$, the resulting toner may have poor low temperature fixing ability.

The weight average molecular weight of the crystalline polyester resin can be measured by GPC, and it is a polystyrene-converted molecular weight.

An amount of the crystalline polyester resin in the toner is generally 3% by mass to 40% by mass, preferably 4% by mass to 35% by mass, and more preferably 5% by mass to 30% by mass. When the amount of the crystalline polyester in the toner is smaller than 3% by mass, the resulting toner may have poor low temperature fixing ability. When the amount thereof is larger than 40% by mass, the resulting toner or fixed image may have insufficient strength, or the resulting toner may have insufficient charging ability.

The non-crystalline polyester can be synthesized by heating polyol and polycarboxylic acid in the presence of a catalyst (e.g., tetrabutoxytitanate, and dibutyl tin oxide) to 150° C. to 280° C., removing the generated water or alcohol, if necessary, and condensing the polyol and polycarboxylic acid.

Examples of the polyol include diol, trivalent or higher polyol. It is preferred that diol be used independently, or in combination with trivalent or higher polyol, as the polyol.

The diol is appropriately selected depending on the intended purpose without any restriction. Examples thereof include: alkykene glycol such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol, and polytetramethylene ether glycol; alicyclic diol such as 1,4-cyclohexane dimethanol, and hydrogenated bisphenol A; bisphenols such as bisphenol A, bisphenol F, and bisphenol S; and alkylene oxide (e.g., ethylene oxide, propylene oxide, and butylene oxide) adducts of the alicyclic diol or the bisphenols. These may be used independently, or in combination. Among them, C2-C12 alkylene glycol and alkylene oxide adducts of bisphenols are preferable, and alkylene oxide adducts of bisphenols, and a combination of alkylene oxide adducts of bisphenols and C2-C12 alkylene glycol are particularly preferable.

Examples of the trivalent or higher polyol include: aliphatic tri- to octa-, or higher polyhydric alcohol such as glycerin, trimethylol ethane, trimethylol propane, pentaerythritol, and sorbitol; trihydric or higher phenols such as trisphenol PA, phenol novolak, and cresol novolak; and alkylene oxide (e.g., ethylene oxide, propylene oxide, and butylene oxide) adducts of the trihydric or higher phenols. These may be used independently, or in combination.

Examples of the polycarboxylic acid include dicarboxylic acid, and trivalent or higher polycarboxylic acid. It is preferred that dicarboxylic acid be used independently, or in combination with trivalent or higher polycarboxylic acid, as the polycarboxylic acid.

The dicarboxylic acid is not particularly restricted, and examples thereof include: alkylene dicarboxylic acid such as succinic acid, adipic acid, and sebacic acid; alkenylene dicarboxylic acid such as maleic acid, and fumaric acid; and aromatic dicarboxylic acid such as phthalic acid, isophthalic acid, terephthalic acid, and naphthalene dicarboxylic acid. These may be used independently, or in combination. Among them, C4-C20 alkenylene dicarboxylic acid and C8-C20 aromatic dicarboxylic acid are preferable.

Examples of the trivalent or higher polycarboxylic acid include C9-C20 aromatic polycarboxylic acid such as trimellitic acid, and pyromellitic acid. These may be used independently, or in combination.

Note that, anhydrides or lower alkyl esters (e.g., methyl ester, ethyl ester, and isopropyl ester) of the polycarboxylic acid may be used instead of the polycarboxylic acid.

The peak molecular weight of the non-crystalline polyester is generally $1\times10^3$ to $3\times10^4$, preferably $1.5\times10^3$ to $1\times10^4$, and more preferably $2\times10^3$ to $8\times10^3$. When the peak molecular weight of the non-crystalline polyester is smaller than $1\times10^3$, the resulting toner may have poor heat resistance storage stability. When the peak molecular weight thereof is larger than $3\times10^4$, the resulting toner may have poor low temperature fixing ability.

The peak molecular weight of the non-crystalline polyester can be measured by GPC, and it is a polystyrene-converted molecular weight.

A hydroxyl value of the non-crystalline polyester is generally 5 mgKOH/g or higher, preferably 10 mgKOH/g to 120 mgKOH/g, and more preferably 20 mgKOH/g to 80 mgKOH/g. When the hydroxyl value of the non-crystalline polyester is lower than 5 mgKOH/g, the resulting toner may have insufficient hot offset resistance, and it may be difficult to attain both heat resistance storage stability and low temperature fixing ability at the same time.

The hydroxyl value of the non-crystalline polyester can be measured in accordance with the method described in JIS K 1557-1.

An acid value of the non-crystalline polyester is generally 0.5 mgKOH/g to 40 mgKOH/g, more preferably 5 mgKOH/g to 35 mgKOH/g. When the acid value thereof is lower than 0.5 mgKOH/g, it may be difficult to negatively charge the resulting toner. When the acid value thereof is higher than 40 mgKOH/g, the resulting toner may be easily affected by the surrounding environment in high temperature high humidity environments, or low temperature and low humidity environments, which may cause deterioration of the resulting images.

The core preferably further contains urea-modified polyester. Having the urea-modified polyester in the core can improves low temperature fixing ability of the resulting toner, and glossiness and uniformity of glossiness in the resulting full-color images.

The urea-modified polyester can be synthesized by subjecting polyester prepolymer containing an isocyanate group and a compound containing an amino group to addition polymerization in the presence of a catalyst such as dibutyl tin laurate, and dioctyl tin laurate. The reaction duration for the addition polymerization is generally 10 minutes to 40 hours, preferably 2 hours to 24 hours. Moreover, the reaction temperature is generally 0° C. to 150° C., preferably 40° C. to 98° C.

The polyester prepolymer containing an isocyanate group can be synthesized by subjecting polyester containing an active hydrogen group and polyisocyanate to addition polymerization at 40° C. to 140° C. Examples of the active hydrogen group include a hydroxyl group (e.g. an alcoholic hydroxyl group, and a phenolic hydroxyl group), an amino group, a carboxyl group, and mercapto group. Among them, an alcoholic hydroxyl group is preferable.

The polyester containing an alcoholic hydroxyl group as the active hydrogen group can be synthesized by subjecting the aforementioned polyol and the aforementioned polycarboxylic acid to condensation polymerization. Here, a molar ratio of the alcoholic hydroxyl group to the carboxyl group is generally 1 to 2, preferably 1 to 1.5, and more preferably 1.02 to 1.3.

The polyisocyanate is appropriately selected depending on the intended purpose without any restriction. Examples of the polyisocyanate include: aliphatic polyisocyanate (e.g., tetramethylene diisocyanate, hexamethylene diisocyanate, and 2,6-diisocyanate methyl caproate); alicyclic polyisocyanate (e.g. isophorone diisocyanate, and cyclohexylmehane diisocyanate); aromatic diisocyanate (e.g. tolylene diisocyanate, and diphenylmethane diisocyanate); aromatic aliphatic diisocyanate (e.g. α,α,α',α'-tetramethyl xylylene diisocyanate); and isocyanirates. These may be used independently, or in combination.

As the polyisocyanate, those blocked with phenol derivatives, oxime, caprolactam, or the like may be used.

For the addition polymerization of the polyester containing an active hydrogen group and the polyisocyanate, a molar ratio of the isocyanate group to the alcoholic hydroxyl group is generally 1 to 5, preferably 1.2 to 4, and more preferably 1.5 to 2.5. When the molar ratio thereof is smaller than 1, the urea bond content in the resulting urea-modified polyester is small, which may result in insufficient hot offset resistance of the resulting toner. When the molar ratio thereof is larger than 5, the resulting toner may have insufficient low temperature fixing ability.

An amount of the component derived from the polyisocyanate in the polyester prepolymer containing an isocyanate group is generally 0.5% by mass to 40% by mass, preferably 1% by mass to 30% by mass, and more preferably 2% by mass to 20% by mass. When the amount thereof is smaller than 0.5% by mass, the resulting toner may have insufficient hot offset resistance. When the amount thereof is larger than 40% by mass, the resulting toner may have insufficient low temperature fixing ability.

The average number of isocyanate groups contained in the polyester prepolymer is generally 1 or more, preferably 1.5 to 3, and even more preferably 1.8 to 2.5 per molecule. When the average number of the isocyanate group is less than 1 per molecule, the resulting urea-modified polyester has a small molecular weight, which may result in insufficient hot offset resistance of the resulting toner.

The compound containing an amino group is appropriately selected depending on the intended purpose without any restriction. Examples thereof include diamine, trivalent or higher polyamine, amino alcohol, amino mercaptan, and amino acid. Among them, diamine, or a combination of diamine and trivalent or higher polyamine are preferable.

Examples of the diamine include: aromatic diamine (e.g. phenylene diamine, diethyl toluene diamine, and 4,4'-diaminodiphenyl methane); alicyclic diamine (e.g. 4,4'-diamino-3,3'-dimethyldichlorohexyl methane, diamine cyclohexane, and isophorone diamine); and aliphatic diamine (e.g. ethylene diamine, tetramethylene diamine, and hexamethylene diamine). These may be used independently, or in combination.

Examples of the trivalent or higher polyamine include diethylene triamine, and triethylene tetramine. These may be used independently, or in combination.

Examples of the amino alcohol include ethanol amine, hydroxyethyl aniline. These may be used independently, or in combination.

Examples of the amino mercaptan include aminoethylmercaptan, and aminopropylmercaptan. These may be used independently, or in combination.

Examples of the amino acid include amino propionic acid, and amino caproic acid. These may be used independently, or in combination.

Moreover, instead of the compound containing the amines, compounds in which amino groups are blocked with ketone (e.g. acetone, methyl ethyl ketone, and methyl isobutyl ketone) may be used.

For the addition reaction of the polyester prepolymer containing an isocyanate group and the compound containing an amino group, a molar ratio of the isocyanate group to the amino group is generally 0.5 to 2, preferably 2/3 to 1.5, and more preferably 5/6 to 1.2. When the molar ratio thereof is smaller than 0.5, or larger than 2, the resulting urea-modified polyester has a small molecular weight, which may result in insufficient hot offset resistance of the resulting toner.

At the time of the addition polymerization of the polyester prepolymer containing an isocyanate group and the compound containing an amino group, a molecular weight of the urea-modified polyester may be adjusted by using monoamine.

Examples of the monoamine include diethylamine, dibutylamine, butylamine, and laurylamine.

Note that, the monoamine the amino group of which is blocked with ketone (e.g., acetone, methyl ethyl ketone, and methyl isobutyl ketone) may be used instead of the monoamine.

It is preferred that the urea-modified polyester and the non-crystalline polyester be compatible to each other at least in part thereof. Specifically, the polyester component of the urea-modified polyester is preferably similar or the same to the formulation of the non-crystalline polyester. Owing to the compatibility between the urea-modified polyester and the non-crystalline polyester, low temperature fixing ability and hot offset resistance of the toner can be improved.

A mass ratio of the urea-modified polyester to the non-crystalline polyester is generally 5/95 to 75/25, preferably 10/90 to 25/75, more preferably 12/88 to 25/75, and even more preferably 12/88 to 22/78. When the mass ratio thereof is less than 5/95, the resulting toner may have insufficient hot offset resistance, and it may be difficult to attain both heat resistance storage stability and low temperature fixing ability of the toner at the same time. When the mass ratio thereof is more than 75/25, the resulting toner may have insufficient low temperature fixing ability.

Note that, the core may further contain modified polyester other than the urea-modified polyester, such as urethane-modified polyester.

<Colorant>

The colorant is appropriately selected depending on the intended purpose without any restriction, provided that it is a dye or a pigment. Examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinone blue, fast violet B, methylviolet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone. These may be used independently, or in combination.

An amount of the colorant in the toner is generally 1% by mass to 15% by mass, preferably 3% by mass to 10% by mass.

The colorant may be used in the form of a master batch in which the colorant forms a composite with a resin.

The resin is appropriately selected depending on the intended purpose without any restriction. Examples thereof include: the non-crystalline polyester and urea-modified polyester mentioned above; styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers); polymethyl methacrylates; polybutyl methacrylates; polyvinyl chlorides; polyvinyl acetates; polyethylenes; polypropylenes; epoxy resins; epoxy polyol resins; polyurethane resins; polyamide resins; polyvinyl butyrals; polyacrylic acid resins; rosin; modified rosin; terpene resins; aliphatic or alicyclic hydrocarbon resins; aromatic petroleum resins; chlorinated paraffin; and paraffin wax. These may be used independently, or in combination.

The master batch can be prepared by mixing and kneading a colorant with the resin. In the mixing and kneading, an organic solvent may be used for improving the interactions between the colorant and the resin.

Moreover, the master batch can be prepared by a flashing method in which an aqueous paste containing a colorant (e.g. a pigment) is mixed and kneaded with a resin and an organic solvent, and then the colorant is transferred to the resin to remove the water and the organic solvent. In this process, a wet cake of the colorant (e.g. the pigment) is used as it is, it is not necessary to dry the wet cake of the colorant to prepare a colorant.

In the mixing and kneading of the pigment and the resin, for example, a high-shearing disperser (e.g., a three-roll mill) may be used.

<Releasing Agent>

The releasing agent is appropriately selected depending on the intended purpose without any restriction. Examples thereof include: polyolefin wax such as polyethylene wax and popypropylene wax; long-chain hydrocarbon such as paraffin wax, and sasol wax; and wax containing a carbonyl group. These may be used independently, or in combination. Among them, the wax containing a carbonyl group is particularly preferable.

Examples of the wax containing a carbonyl group include: polyalkanoic acid esters such as carnauba wax, montan wax, trimethylol propane tribehenate, pentaerythritol tetrabehenate, pentaerythritol diacetate dibehenate, glycerin tribehenate, and 1,18-octadecanediol distearate; polyalkanol esters such as tristearyl trimellitate, and distearyl maleate; polyalkanoic acid amides such as ethylene diamine dibehenyl amide; polyalkyl amide such as trimellitic acid tristearyl amide; and dialkyl ketone such as distearyl ketone. Among them, the polyalkanoic acid ester is particularly preferable.

The melting point of the releasing agent is generally 40° C. to 160° C., preferably 50° C. to 120° C., and more preferably 60° C. to 90° C. When the melting point of the releasing agent is lower than 40° C., the heat resistance storage stability of the resulting toner may be low. When the melting point thereof is higher than 160° C., the resulting toner may cause cold offset as fixed at low temperature.

A melt viscosity of the releasing agent at the temperature higher than the melting point of the releasing agent by 20° C. is generally preferably 5 cps to 1,000 cps, more preferably 10 cps to 100 cps. When the melt viscosity thereof at the temperature higher than the melting point thereof by 20° C. is lower than 5 cps, dispersibility of the releasing agent may be insufficient in the core. When the melt viscosity thereof is higher than 1,000 cps, the resulting toner may have poor hot offset resistance and low temperature fixing ability.

An amount of the releasing agent in the toner is generally 0% by mass to 40% by mass, preferably 3% by mass to 30% by mass.

The resin contained in the shell is not particularly restricted, as long as it can be dispersed in the aqueous medium explained later, but it is preferably a vinyl resin or polyester.

Examples of the vinyl resin include: acids such as acrylic acid, methacrylic acid, α-cyanoacrylic acid, α-cyanomethacrylic acid, itaconic acid, crotonic acid, fumaric acid, maleic acid, and maleic anhydride; (meth)acryl-based monomers containing a hydroxyl group, such as β-hydroxyethyl acrylate, β-hydroxyethyl methacrylate, β-hydroxypropyl acrylate, γ-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acryl amide, and N-methylol methacryl amide; vinyl alcohol; ethers of vinyl alcohol, such as vinyl methyl ether, vinyl ethyl ether, and vinyl propyl ether; esters of vinyl alcohol and carboxylic acid, such as vinyl acetate, vinyl propionate, and vinyl butyrate; acryl amide, methacryl amide, diacetone acryl amide, and methylols thereof; acid chloride such as acrylic acid chloride, and methacrylic acid chloride; homopolymer or copolymer of those including a nitrogen atom (e.g., vinyl pyridine, vinyl propydone, vinyl imidazole, and ethylene imine) or heterocycle thereof.

Examples of the polyester include the aforementioned crystalline polyester and the aforementioned non-crystalline polyester.

In order to disperse the resin to be contained in the shell in the aqueous medium, acid treatment or alkaline treatment may be performed on the resin.

The glass transition temperature of the resin to be contained in the shell is generally 40° C. to 100° C. When the glass transition temperature thereof is lower than 40° C., the heat resistance storage stability of the resulting toner may be low. When the glass transition temperature thereof is higher than 100° C., the low temperature fixing ability of the resulting toner may be low.

The weight average molecular weight of the resin to be contained in the shell is generally $3\times10^3$ to $3\times10^5$. When the weight average molecular weight of the resin contained in the shell is smaller than $3\times10^3$, the resulting toner may have poor heat resistance storage stability. When the weight average molecular weight thereof is larger than $3\times10^5$, the resulting toner may have poor low temperature fixing ability.

An amount of the resin contained in the shell of the toner is generally 0.5% by mass to 5.0% by mass. When the amount of the resin contained in the shell of the toner is smaller than 0.5% by mass, the resulting toner may have poor heat resistance storage stability. When the amount thereof is larger than 5.0% by mass, the resulting toner may have poor hot offset resistance.

Note that, the amount of the resin contained in the shell of the toner can be determined by analyzing the compound originated from the resin contained in the shell, but not originated from the materials constituting the toner other than the resin as mentioned, and calculating the peak area thereof, using a thermal decomposition gas chromatograph mass spectrometer.

—Charge Controlling Agent—

The core may further contain a charge controlling agent.

The charge controlling agent is appropriately selected depending on the intended purpose without any restriction. Examples of the charge controlling agent include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine-based active agents, metal salts of salicylic acid, metal salts of salicylic acid derivatives, copper phthalocyanine, perylene, quinacridon, and an azo pigment. These may be used independently, or in combination. Other examples of the charge controlling agent include polymer compounds having functional groups such as a sulfonic acid group, a carboxyl group, and a quaternary ammonium salt group.

Examples of commercial products of the charge controlling agent include: BONTRON 03 (nigrosine dye), BONTRON P-51 (quaternary ammonium salt), BONTRON S-34 (metal azo-containing dye), E-82 (oxynaphthoic acid-based metal complex), E-84 (salicylic acid-based metal complex) and E-89 (phenol condensate), all manufactured by ORIENT CHEMICAL INDUSTRIES CO., LTD; TP-302 and TP-415 (quaternary ammonium salt molybdenum complexes) both manufactured by Hodogaya Chemical Co., Ltd.; COPY CHARGE PSY VP 2038 (quaternary ammonium salt), COPY BLUE PR (triphenylmethane derivative), COPY CHARGE NEG VP2036 and COPY CHARGE NX VP434 (quaternary ammonium salts), all manufactured by Hoechst AG; and LRA-901 and LR-147 (boron complex), both manufactured by Japan Carlit Co., Ltd.

An amount of the charge controlling agent in the toner is generally 0% by mass to 10% by mass, preferably 0.2% by mass to 5% by mass relative to the total mass of the crystalline polyester and the non-crystalline polyester. When the amount of the charge controlling agent in the toner is larger than 10% by mass relative to the total mass of the crystalline polyester and the non-crystalline polyester, the electrostatic propensity of the resulting toner is excessively large so that the electrostatic suction force toward the developing roller may increase, which may cause poor flowing ability of the developer, and low image density.

It is preferred that the shell further contain polylactate for controlling the viscoelstic properties of the toner.

The base particles can be formed by: emulsifying or dispersing, in an aqueous medium containing particles including the resin therein, a liquid obtained by dissolving or dispersing a toner material containing crystalline polyester, non-crystalline polyester, polyester prepolymer containing an isocyanate group, a compound containing an amino group, a colorant, and a releasing agent in an organic solvent; and removing the organic solvent. The toner material may further contain a charge controlling agent.

The aqueous medium is appropriately selected depending on the intended purpose without any restriction. Examples of the aqueous medium include water, a mixed solvent of water and a solvent miscible with water.

The solvent miscible with water is appropriately selected depending on the intended purpose without any restriction. Examples thereof include alcohols (e.g. methanol, isopropanol, and ethylene glycol), dimethylformamide, tetrahydrofuran, cellosolves (e.g. methyl cellosolve), and lower ketones (e.g. acetone, and methyl ethyl ketone). These may be used independently, or in combination.

For emulsifying or dispersing in the aqueous medium the liquid in which the toner material is dissolved or dispersed in the organic solvent, a disperser, such as a low-speed shearing disperser, a high-speed shearing disperser, a friction disperser, a high-pressure jetting disperser and ultrasonic wave disperser, can be used. Among them, the high-speed shearing disperser is preferable for attaining dispersed elements having particle diameters of 2 μm to 20 μm.

In use f the high-speed shearing disperser, the rotating speed is generally $1\times10^3$ rpm to $3\times10^4$ rpm, preferably $5\times10^3$ rpm to $2\times10^4$ rpm. The duration for dispersing is generally 0.1 minutes to 5 minutes in case of the batch system. Moreover, the temperature during the dispersing is generally 0° C. to 150° C. (in the pressurized state), preferably 40° C. to 98° C. The higher the temperature during the dispersing is, easier the dispersing is because the viscosity of the liquid prepared by emulsifying or dispersing in the aqueous medium the liquid in which the toner material is dissolved or dispersed in the organic solvent reduces.

Note that, the toner material excluding the polyester prepolymer containing an isocyanate group may be added and mixed at the time when the liquid in which the toner material is dissolved or dispersed in the organic solvent is emulsified or dispersed in the aqueous medium.

Alternatively, base particles may be formed without including the colorant, and then the colorant may be added to the base particles by any of the conventional dying methods.

The mass ratio of the aqueous medium to the toner material is generally 0.5 to 20, preferably 1 to 10. When the mass ratio of the aqueous medium to the toner material is less than 0.5, the toner material may not be in a desirable dispersed state, and thus toner particles of the predetermined particle diameters may not be obtained. When the mass ratio thereof is greater than 20, it is not economically desirable.

The aqueous medium may further contain a dispersant such as a surfactant, and an inorganic compound that is hardly soluble in water. Use of the dispersant improves the dispersion stability of the liquid obtained by emulsifying or dispersing in the aqueous medium the liquid in which the toner material is dissolved or dispersed in the organic solvent, as well as attaining a narrow particle dize distribution of the resulting toner.

The surfactant is appropriately selected depending on the intended purpose without any restriction. Examples thereof include: anionic surfactants such as alkylbenzenesulfonic acid salts, α-olefin sulfonic acid salts and phosphoric acid esters; cationic surfactants such as amine salts (e.g., alkyl amine salts, amino alcohol fatty acid derivatives, polyamine fatty acid derivatives and imidazoline), and quaternary ammonium salts (e.g., alkyltrimethylammonium salts, dialkyl dimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyldi (aminoethyl)glycine, bis(octylaminoethyl)glycine and N-alkyl-N,N-dimethylammonium betaine. These may be used independently, or in combination. Among them, a fluoroalkyl group-containing surfactant is particularly preferable, because it is effective with a small amount thereof.

Examples of the fluoroalkyl group-containing anionic surfactant include fluoroalkyl carboxylic acid having 2 to 10 carbon atoms and metal salts thereof, disodium perfluorooctanesulfonylglutamate, sodium 3-[ω-fluoroalkyl(C6-C11) oxy)-1-alkyl(C3-C4)sulfonate, sodium 3-[ω-fluoroalkanoyl (C6-C8)-N-ethylamino]-1-propanesulfonate, fluoroalkyl (C11-C20)carboxylic acid and metal salts thereof, perfluoroalkylcarboxylic acid(C7-C13) and metal salts thereof, perfluoroalkyl(C4-C12)sulfonate and metal salts thereof, perfluorooctanesulfonic acid diethanol amide, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin and monoperfluoroalkyl(C6-C16)ethylphosphate. These may be used independently, or in combination.

Examples of the commercial product of the fluoroalkyl group-containing anionic surfactant include: SURFLON S-111, S-112 and S-113 (these products are of Asahi Glass Co., Ltd.); FRORARD FC-93, FC-95, FC-98 and FC-129 (these products are of Sumitomo 3M Ltd.); UNIDYNE DS-101 and DS-102 (these products are of Daikin Industries, Ltd.); MEGAFACE F-110, F-120, F-113, F-191, F-812 and F-833 (these products are of Dainippon Ink and Chemicals, Inc.); EFTOP EF-102, 103, 104, 105, 112, 123A, 123B, 306A, 501, 201 and 204 (these products are of Tohchem Products Co., Ltd.); and FUTARGENT F-100 and F-150 (these products are of NEOS COMPANY LIMITED).

The fluoroalkyl group-containing anionic surfactant is appropriately selected depending on the intended purpose without any restriction. Examples thereof include fluoroalkyl group-containing primary, secondary or tertiary aliphatic amine acids, aliphatic quaternary ammonium salts (e.g., perfluoroalkyl (C6-C10)sulfone amide propyltrimethyl ammonium salts), benzalkonium salts, benzetonium chloride, pyridinium salts and imidazolinium salts.

Examples of commercial products of the fluoroalkyl group-containing anionic surfactant include SURFLON S-121 to (product of Asahi Glass Co., Ltd.); FRORARD FC-135 (product of Sumitomo 3M Ltd.); UNIDYNE DS-202 (product of Daikin Industries, Ltd.); MEGAFACE F-150 and F-824 (these products are of Dainippon Ink and Chemicals, Inc.); EFTOP EF-132 (product of Tohchem Products Co., Ltd.); and FUTARGENT F-300 (product of Neos COMPANY LIMITED).

The poorly water-soluble inorganic compound is appropriately selected depending on the intended purpose without any restriction. Examples thereof include tricalcium phosphate, calcium carbonate, titanium oxide, colloidal silica, and hydroxyapatite.

In the case where a dispersant is used, the base particles on surfaces of which the dispersant is remained may be used. However, in view of the charging ability of the resulting toner, it is preferred that the dispersant be removed by washing and the base particles from which the dispersant has been removed be used. In the case where a compound soluble in acid and alkali, such as calcium phosphate is used as a dispersant, the calcium phosphate can be removed from the base particles by dissolving the calcium phosphate, followed by washing the base particles with water. Alternatively, it can be removed from the base particles by decomposing it using enzyme.

A method for removing the organic solvent is appropriately selected depending on the intended purpose without any restriction. Examples thereof include a method in which an organic solvent is evaporated by means of a rotary evaporator.

After removing the organic solvent, fine particles are removed from the obtained particles by centrifugal separation, the classified particles are washed in a washing tank, and then dried by means of a hot air dryer. This series of operations are repeated to thereby obtain base particles.

After removing the organic solvent, it is preferred that maturing be performed on the particles. The temperature for the maturing is generally 30° C. to 55° C., preferably 40° C. to 50° C. The duration for the maturing is generally 5 hours to 36 hours, preferably 10 hours to 24 hours.

As another method for removing the organic solvent, there is a method in which the liquid obtained by emulsifying or dispersing in the aqueous medium the liquid in which the toner material is dissolved or dispersed in the organic solvent is sprayed and evaporate the organic solvent and the aqueous medium using, for example, a spray dryer, a belt dryer or a rotary kiln. The dry atmosphere is not particularly restricted, and examples thereof include heated gas (e.g., air, nitrogen, carbon dioxide and combustion gas) at the temperature equal to or higher than the boiling points of the organic solvent and aqueous medium.

When the particle size distribution of the base particles is broad, fine particles are removed from the base particles by a cyclone, a decanter, or a centrifugal separator.

Next, the base particles and a flow improving agent are mixed using HENSCHEL MIXER or the like, to thereby fix the flow improving agent on surfaces of the base particles. After fixing the flow improving agent on the surfaces of the base particles, coarse particles can be removed by ultrasonic sieve or the like.

The flow improving agent is appropriately selected depending on the intended purpose without any restriction. Examples thereof include inorganic particles, and hydrophobic-processed inorganic particles. These may be used independently, or in combination.

The average primary particle diameter of the flow improving agent is generally 1 nm to 100 nm, preferably 3 nm to 70 nm. When the average primary particle diameter thereof is smaller than 1 nm, the flow improving agent may be embedded in the base particles. When the average primary particle thereof is larger than 100 nm, the resulting toner may unevenly damage a surface of a photoconductor during the developing.

The flow improving agent preferably contains a group of particles having the average primary particle diameter of 20 nm or smaller, and a group of particles having the average primary particle diameter of 30 nm or larger.

The BET specific surface area of the flow improving agent is generally 20 $m^2/g$ to 500 $m^2/g$.

The inorganic particles are appropriately selected depending on the intended purpose without any restriction.

Examples thereof include silica, alumina, titanium oxide, barium titanate, magnesium titanate, calcium titanate, strontium titanate, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. Among them, silica and titania are preferable.

Examples of commercial products of the silica particles include: HDK H 2000, HDK H 2000/4, HDK H 2050EP, HVK21, and HDK H 1303 (all manufactured by Hoechst AG); and R972, R974, RX200, RY200, R202, R805, and R812 (all manufactured by Nippon Aerosil Co., Ltd.).

Examples of commercial products of the titania particles include: P-25 (manufactured by Nippon Aerosil Co., Ltd.); STT-30, and STT-65C-S (both manufactured by Titan Kogyo, Ltd.); TAF-140 (manufactured by Fuji Titanium Industry Co., Ltd.); and MT-150W, MT-500B, MT-600B, and MT-150A (all manufactured by TAYCA CORPORATION).

By subjecting the inorganic particles to the hydrophobic treatment, reduction in flowability or charging ability of the resulting toner can be prevented even in high humidity environments.

A treating agent for the hydrophobic treatment of the inorganic particles is appropriately selected depending on the intended purpose without any restriction. Examples thereof include a silane coupling agent (e.g., methyl trimethoxy silane, methyl triethoxy silane, and octyl trimethoxy silane), a sililating agent, a silane coupling agent containing a fluoroalkyl group, an organic titanate-based coupling agent, an aluminum-based coupling agent, and silicone oil.

The silicone oil is appropriately selected depending on the intended purpose without any restriction. Examples thereof include dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether modified silicone oil, phenol-modified silicone oil, carboxyl-modified silicone oil, mercapto-modified silicone oil, (meth)acryl-modified silicone oil, and α-methyl styrene-modified silicone oil.

Examples of the hydrophobic-treated titania particles include: T-805 (manufactured by Nippon Aerosil Co., Ltd.); STT-30A, and STT-65S-S (both manufactured by Titan Kogyo, Ltd.); TAF-500T, and TAF-1500T (both manufactured by Fuji Titanium Industry Co., Ltd.); MT-100S, and MT-100T (both manufactured by TAYCA CORPORATION); and IT-S (manufactured by ISHIHARA SANGYO KAISHA, LTD.).

An amount of the flow improving agent in the toner is generally 0.1% by mass to 5% by mass, preferably 0.3% by mass to 3% by mass.

At the time when the base particles and the flow improving agent are mixed, a cleaning improving agent may be added thereto.

The cleaning improving agent is appropriately selected depending on the intended purpose without any restriction, and examples thereof include: fatty acid metal salts such as zinc stearate, and calcium stearate; particles of a resin produced by polymerization condensation, such as polystyrene, (meth)acrylic acid ester copolymer, a silicone resin, benzoguanamine, and nylon; and particles of a thermoset resin.

The resin particles can be produced by soap-free emulsification polymerization, suspension polymerization, dispersion polymerization, or the like, and preferably have a relatively narrow particle size distribution, and the volume average particle diameter of 0.01 μm to 1 μm.

The average circularity of the toner is preferably 0.93 to 0.99. When the average circularity of the toner is less than 0.93, the toner has undesirable transfer properties so that high quality images may not be formed with such the toner. When the average circularity thereof is more than 0.99, cleaning failures may occur on a photoconductor or a transfer belt.

Note that, the average circularity of the toner can be calculated by measuring the toner by means of a flow particle image analyzer FPIA-2100 (manufactured Sysmex Corporation), and analyzing the results with an analysis software FPIA-2100 Data Processing Program for FPIA version 00-10.

The toner preferably has the shape factor SF-1 of 100 to 150. When the shape factor SF-1 of the toner is more than 150, the toner has irregular shape, so that the movement of the toner image is not smoothly carrier out at the time when the toner image is transferred, and moreover the toner particles vary their behaviors so that high transfer efficiency cannot be achieved. In addition, the toner may become brittle as well as having unstable charge. As a result, the toner is turned into fine powder in the developer, which reduces the durability of the developer.

The toner preferably has the shape factor SF-2 of 100 to 140. When the shape factor SF-2 of the toner is more than 140, the transfer ability of the toner may be insufficient.

Note that, the shape factors SF-1 and SF-2 can be calculated by sampling 300 toner particles, which has been randomly selected from a photograph taken by a field emission scanning microscope (S-4200, manufactured by Hitachi, Ltd.), sending the sampled image information to an image analyzer (Luzex AP, manufactured by NIRECO CORPORATION) via an interface, and analyze the information.

The weight average particle diameter of the toner is preferably 2 μm to 7 μm, more preferably 2 μm to 5 μm. When the weight average particle diameter of the toner is smaller than 2 μm, the toner may fuse on surfaces of carrier particles by stirring over a long time period in a developing device, which may reduce the charging ability of the carrier. When the weight average particle diameter thereof is larger than 7 μm, it may be difficult to form images of high quality and high dissolution, and moreover, in the case where the toner is continuously supplied to the developer to compensate the consumed toner, variations in the toner particle diameters may become significant.

A ratio of the weight average particle diameter of the toner to the number average particle diameter of the toner is preferably 1.00 to 1.25, more preferably 1.00 to 1.15. When the ratio thereof is larger than 1.25, behaviors of the toner particles vary during the developing, which reduces the reproducibility of fine dots, so that high quality images may not be formed.

Note that the weight average particle diameter and number average particle diameter of the toner can be measured by Coulter Multisizer II (manufactured by Beckman Coulter, Inc.).

The glass transition temperature of the toner is generally 40° C. to 70° C., preferably 45° C. to 55° C. When the glass transition temperature thereof is lower than 40° C., the heat resistance storage stability of the toner may be low. When the glass transition temperature thereof is higher than 70° C., the low temperature fixing ability of the toner may be low.

The temperature TG', at which the storage modulus of the toner is $1\times10^4$ dyne/cm$^2$ with the frequency of 20 Hz, is generally 100° C. or higher, preferably 110° C. to 200° C. When TG' of the toner is lower than 100° C., the hot offset resistance of the toner may be low.

The temperature Tη, at which the viscosity of the toner is $1\times10^3$ P with the frequency of 20 Hz, is generally 180° C. or lower, preferably 90° C. to 160° C. When Tη of the toner is higher than 180° C., the low temperature fixing ability of the toner may be low.

TG'-Tη is generally 0° C. to 100° C., preferably 10° C. to 90° C., and more preferably 20° C. to 80° C. When TG'-Tη is lower than 0° C., it may be difficult to achieve both low temperature fixing ability and hot offset resistance of the toner. When TG'-Tη is higher than 100° C., the heat resistance storage stability of the toner may be low.

The developer of the present invention contains the toner of the present invention and a carrier. A mass ratio of the toner to the carrier is preferably 1% by mass to 10% by mass.

The carrier is appropriately selected depending on the intended purpose without any restriction. Examples thereof include iron powder, ferrite powder, magnetite powder each having particle diameters of 20 μm to 200 μm.

Surfaces of the carrier particles may be coated with a resin. The resin for coating the carrier particles is not particularly restricted, and examples thereof include: an amino-based resin such as a urea-formaldehyde resin, a melamine resin, a benzoguanamine resin, a urea resin, a polyamide resin, and an epoxy resin; an acrylic resin such as methyl polymethacrylate, and polyacrylonitrile; a polyvinyl alcohol-based resin such as polyvinyl acetate, polyvinyl alcohol, and polyvinyl butyral resin; a polystyrene-based resin such as a polystyrene resin, and a styrene-acryl copolymer; a halogenated olefin resin such as polyvinyl chloride; polyester such as polyethylene terephthalate, and polybutylene terephthalate; polycarbonate; polyethylene; a fluororesin such as polyvinyl fluoride, polyvinylidene fluoride, polytrifluoroethylene, polyhexafluoropropylene, a copolymer of vinylidene fluoride and an acryl monomer, a copolymer of vinylidene fluoride and vinyl fluoride, a terpolymer of tetrafluoroethylene, vinylidene fluoride, and a non-fluoromonomer; and a silicone resin.

Moreover, the resin coating may contain conductive powder. The conductive powder is appropriately selected depending on the intended purpose without any restriction. Examples thereof include metal powder, carbon black, titanium oxide, tin oxide, and zinc oxide.

The conductive powder preferably has the average particle diameter of 1 μm or smaller. When the average particle diameter of the conductive powder is larger than 1 μm, it may be difficult to control the electric resistance.

(Image Forming Method)

The image forming method of the present invention is a method for forming a full-color image with a tandem image forming apparatus, and the method contains: forming a plurality of latent electrostatic images on a plurality of latent electrostatic image bearing members, respectively; developing the latent electrostatic images formed on the latent electrostatic image bearing members with the developer of the present invention to form toner images, respectively; successively transferring (primary transferring) the toner images formed on the latent electrostatic image bearing members onto an intermediate transfer member to form a full-color toner image; transferring (secondary transferring) the full-color toner image formed on the intermediate transfer member onto a recording medium; and pressing and heating the full-color toner image transferred on the recording medium at bearing of $1\times10^5$ Pa to $3\times10^7$ Pa for 0.03 seconds to 0.4 seconds, to fix the full-color toner image on the recording medium. The method may further contain other steps, if necessary.

Figure 5:
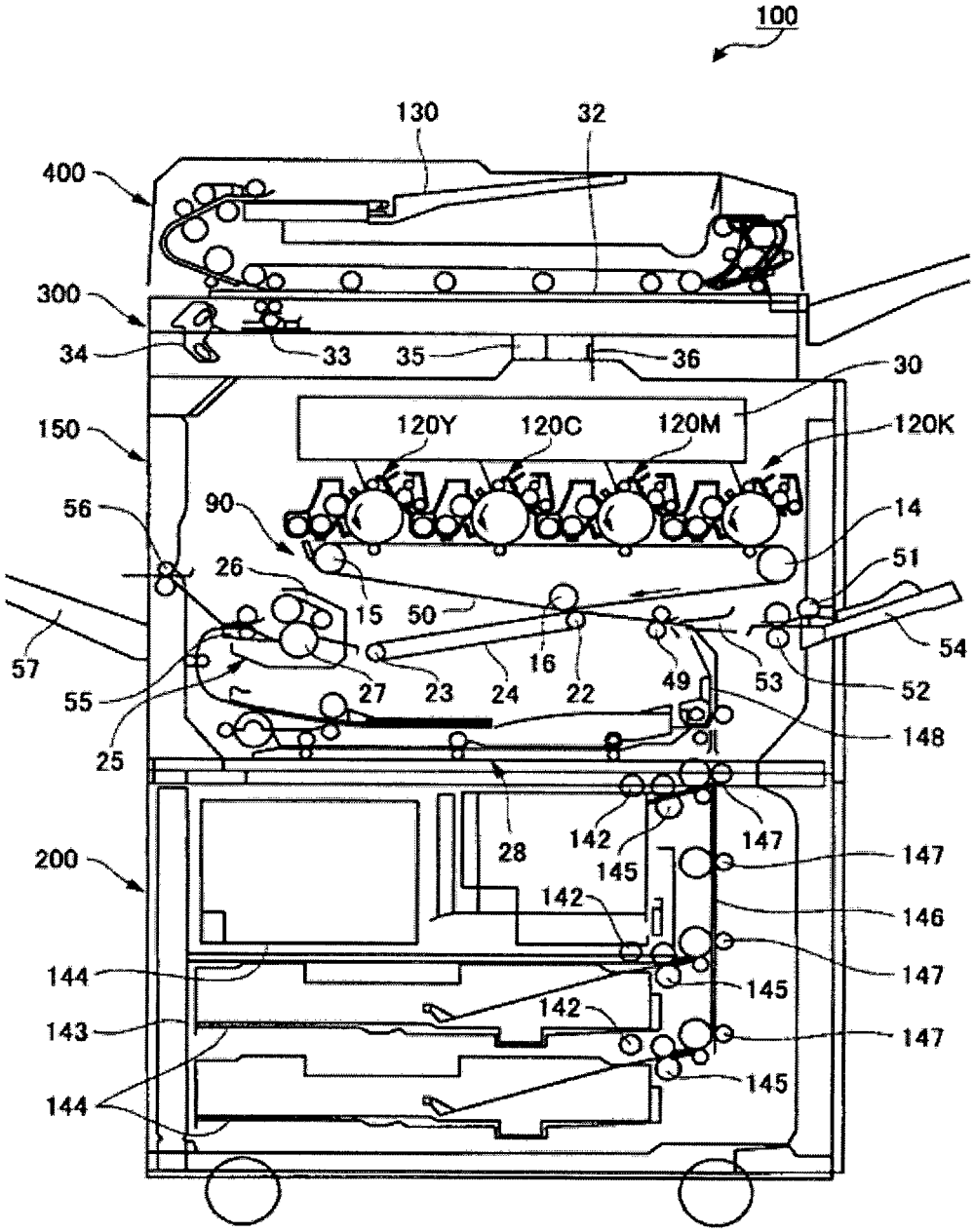
FIG. 5 is a diagram illustrating one example of an image forming apparatus for use in the present invention.

One example of an image forming apparatus for use in the present invention is illustrated in FIG. 5. The image forming apparatus 100 is a tandem-type color image forming apparatus, and contains a photocopying device main body 150, a paper feeding table 200, a scanner 300, and an automatic document feeder (ADF) 400.

The intermediate transfer belt 50 provided in the central part of the photocopying device main body 150 is an endless belt rotatably stretched around three rollers 14, 15, and 16 in the direction shown with the arrow in the diagram. Adjacent to the roller 15, a cleaning device 90 having a cleaning blade is provided for removing the toner remained on the intermediate transfer belt 50. Yellow, cyan, magenta, and black image forming units 120Y, 120C, 120M and 120K are aligned along with the transporting direction so as to face the intermediate transfer belt 50 supported by the rollers 14 and 15. Moreover, an exposing device 30 is provided adjacent to the image forming unit 120. Furthermore, a transfer belt 24 is provided on the opposite side of the intermediate transfer belt 50 to the side where the image forming unit 120 is provided. Note that, the transfer belt 24 is an endless belt stretched around a pair of rollers 22 and 23, and provided so that recording paper transported on the transfer belt 24 can be in contact with the intermediate transfer belt 50 in the area between the rollers 16 and 22. Adjacent to the transfer belt 24, a fixing device 25 equipped with a fixing belt 26, which is an endless belt stretched around a pair of rollers, and a pressure roller 27 disposed so as to pressurize the fixing belt 26 is provided. In the case where images are formed on the both sides of the recording paper, a sheet reverser 28 for reversing the recording paper is provided adjacent to the transfer belt 24 and the fixing device 25.

The fixing device 25 applies pressure at the bearing of $1\times10^5$ Pa to $3\times10^7$ Pa for 0.03 seconds to 0.4 seconds to the recording paper onto which a toner image has been transferred, as well as heating, to thereby fix the toner image. When the bearing for pressing the recording paper is lower than $1\times10^5$ Pa, the fixation of the toner image is insufficient at the time when the toner image is fixed at low temperature. When the bearing is higher than $3\times10^7$ Pa, the recording paper is curled, or quality of the resulting image is impaired. When the duration for pressing the recording paper is shorter than 0.03 seconds, the fixation of the toner image is insufficient. When the duration is longer than 0.4 seconds, hot offset tends to occur.

Moreover, the system speed is preferably 0.2 m/s to 3 m/s. When the system speed is slower than 0.2 m/s, hot offset tends to occur in addition to the fact that an image cannot be formed at high speed. When the system speed is faster than 3 m/s, the fixation of the toner image is insufficient.

Note that, the bearing for pressing the recording paper can be measured by a pressure distribution measuring device (PINCH, manufactured by NITTA CORPORATION).

Moreover, the duration for pressing the recording medium is determined as a ratio of a fixing nip width to the system speed.

The system speed v[m/s] is obtained by passing A4 size paper through in the lengthwise direction, measuring the time t[s] required for forming images continuously on 100 sheets of the paper, and calculating from the following expression:

$$v=100\times0.297/t$$

Note that, the length in the lengthwise direction of the A4 size paper is 0.297 m.

A method for forming a full-color image using the image forming apparatus 100 will be explained next. At first, a color document is set on a document table 130 of the automatic document feeder (ADF) 400. Alternatively, the automatic document feeder (ADF) 400 is opened, a color document is set on a contact glass 32 of the scanner 300, and then the ADF 400 is closed. In the case where the document is set on the ADF 400, once a start switch (not illustrated) is pressed, the document is transported onto the contact glass 32, and then the scanner 300 is driven to scan the document with a first carriage 33 equipped with a light source and a second carriage 34 equipped with a mirror. In the case where the document is set on the contact glass 32, the scanner 300 is immediately driven in the same manner as mentioned. During this scanning operation, light applied from the first carriage 33 is reflected on the surface of the document, the reflected light from the document is further reflected by the second carriage 34, passed through an image forming lens 35 to receive a read sensor 36. In this manner, the document is read, and image information of black, yellow, magenta, cyan is obtained.

Figure 6:
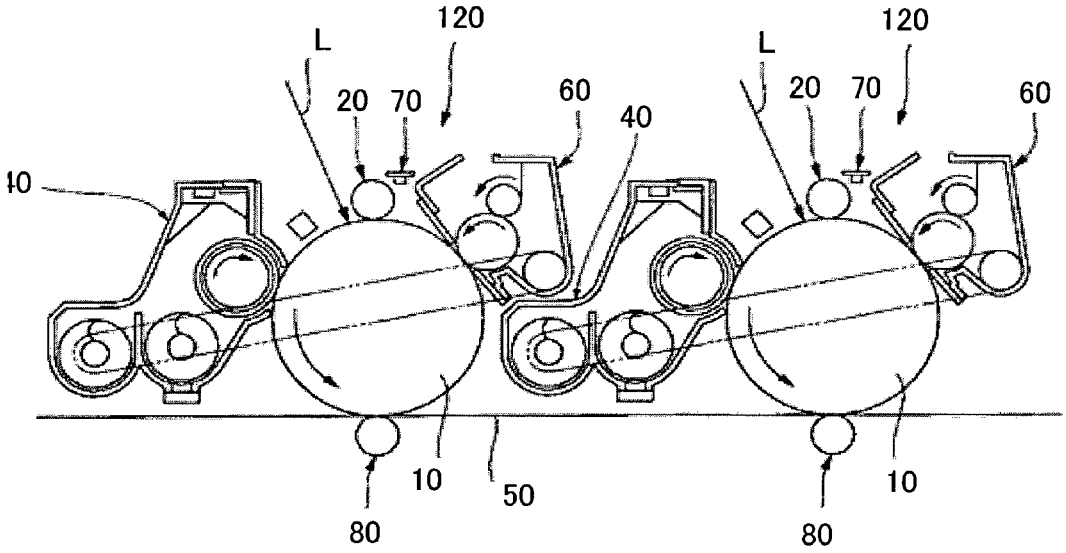
FIG. 6 is a diagram illustrating an image forming unit of FIG. 5.

The image information of each color is transmitted to the image forming unit 120 of each color to form a toner image of each color. As illustrated in FIG. 6, the image forming unit 120 of each color is equipped with a photoconductor drum 10, a charging roller 20 configured to uniformly charge the photoconductor drum 10 to form a latent electrostatic image, a developing device 40 configured to develop the latent electrostatic image with a developer of each color to form a toner image of each color, a transfer roller 80 configured to transfer the toner image onto an intermediate transfer belt 50, a cleaning device 60 having a cleaning blade, and a diselectrification lamp 70.

Toner images of four colors formed by the image forming unit 120 of each color are successively transferred (primary transferred) onto the intermediate transfer member (i.e. the intermediate transfer belt) 50, which is rotatably supported by the rollers 14, 15, and 16, to superimpose the toner images to thereby form a composite toner image.

In the paper feeding table 200, one of the feeding rollers 142 is selectively rotated to eject recording paper from one of multiple feeder cassettes 144 of a paper bank 143, the ejected recording paper is separated one by one by a separation roller 145 to send to a feeder path 146, and then transported by a transport roller 147 into a feeder path 148 in the photocopying device main body 150. The recording paper transported in the feeder path 148 is then bumped against a registration roller 49 to stop. Alternatively, the recording paper on a manual-feeding tray 54 is ejected by rotating a feeding roller 51, separated one by one by a separation roller 52 to guide into a manual feeding path 53, and then stopped by the registration roller 49. Note that, the registration roller 49 is generally earthed at the time of the use, but it may be biased for removing paper dust of the recording paper. Next, the registration roller 49 is rotated synchronously with the movement of the composite toner image formed on the intermediate transfer belt 50 to transport the recording paper into the space between the intermediate transfer belt 50 and the transfer belt 24, to thereby transfer (secondary transfer) the composite toner image onto the recording paper. Note that, the residual toner on the intermediate transfer belt 50, from which the composite toner image has been transferred, is removed by the cleaning device 90.

The recording paper on which the composite toner image has been transferred is transported by the transfer belt 24, followed by fixing the composite toner image by the fixing device 25. Next, the recording paper is changed its traveling direction by a switch craw 55, to be ejected onto an output tray 57 by an ejecting roller 56. Alternatively, the recording paper is changed its traveling direction by the switch craw 55, reversed by the sheet reverser 28 to form an image on the back surface of the recording medium in the same manner as mentioned above, and then ejected onto the output tray 57 by the ejecting roller 56.

Note that, the image forming apparatus 100 employs an indirect transfer system, where a toner image of each color formed by the image forming unit 120 of each color is successively transferred (primary transferred) onto the intermediate transfer medium (i.e. intermediate transfer belt) 50 to superimpose the toner images, and then transferred onto recording paper, but the image forming apparatus 100 may employ a direct transfer system, where a toner image of each color formed by the image forming unit 120 of each color is successively transferred and superimposed on recording paper.

Moreover, a transfer roller may be used instead of the transfer belt 24.

EXAMPLES

The present invention will be more specifically explained through Examples, hereinafter, but Examples shall not be construed as to limit the scope of the present invention in any way. Note that, "part(s)" described below means "part(s) by mass."

[Preparation of Vinyl Resin Dispersion Liquid 1]

A reaction vessel equipped with a stirring rod and a thermometer was charged with 683 parts of ion-exchanged water, 11 parts of a sodium salt of sulfuric acid ester of methacrylic acid-ethylene oxide adduct (ELEMINOL RS-30, manufactured by Sanyo Chemical Industries, Ltd.), 10 parts of polylactic acid, 60 parts of styrene, 100 parts of methacrylic acid, 70 parts of butyl acrylate, and 1 part of ammonium persulfate, the mixture was then stirred for 30 minutes at $3.8\times10^3$ rpm, and heated to 75° C. to react for 4 hours. Next, to the resulting reaction mixture, 30 parts of 1% by mass ammonium persulfate aqueous solution was added, and the resultant was matured for 6 hours at 75° C., to thereby obtain Vinyl Resin Dispersion Liquid 1. The volume average particle diameter of Vinyl Resin Dispersion Liquid 1 was measured by a laser diffraction/scattering particle analyzer (LA-920, manufactured by Horiba, Ltd.), and the volume average particle diameter thereof was 280 nm. Moreover, the vinyl resin contained in Vinyl Resin Dispersion Liquid 1 was separated and subjected to the measurement. As a result, it was found that the glass transition temperature of the vinyl resin was 59° C., and the weight average molecular weight thereof was $6\times10^4$.

[Preparation of Vinyl Resin Dispersion Liquid 2]

A reaction vessel equipped with a stirring rod and a thermometer was charged with 683 parts of ion-exchanged water, 11 parts of a sodium salt of sulfuric acid ester of methacrylic acid-ethylene oxide adduct (ELEMINOL RS-30, manufactured by Sanyo Chemical Industries, Ltd.), 10 parts of polylactic acid, 60 parts of styrene, 100 parts of methacrylic acid, 70 parts of butyl acrylate, and 1 part of ammonium persulfate, the mixture was then stirred for 20 minutes at $3.8\times10^3$ rpm, and heated to 75° C. to react for 3 hours. Next, to the resulting reaction mixture, 30 parts of 1% by mass ammonium persulfate aqueous solution was added, and the resultant was matured for 12 hours at 65° C., to thereby obtain Vinyl Resin Dispersion Liquid 2. The volume average particle diameter of Vinyl Resin Dispersion Liquid 2 was measured by a laser diffraction/scattering particle analyzer (LA-920, manufactured by Horiba, Ltd.), and the volume average particle diameter thereof was 390 nm. Moreover, the vinyl resin contained in Vinyl Resin Dispersion Liquid 2 was separated and subjected to the measurement. As a result, it was found that the glass transition temperature of the vinyl resin was 60° C., and the weight average molecular weight thereof was $7\times10^4$.

[Preparation of Vinyl Resin Dispersion Liquid 3]

A reaction vessel equipped with a stirring rod and a thermometer was charged with 683 parts of ion-exchanged water, 11 parts of a sodium salt of sulfuric acid ester of methacrylic acid-ethylene oxide adduct (ELEMINOL RS-30, manufactured by Sanyo Chemical Industries, Ltd.), 10 parts of polylactic acid, 60 parts of styrene, 100 parts of methacrylic acid, 70 parts of butyl acrylate, and 1 part of ammonium persulfate, the mixture was then stirred for 20 minutes at $2.0\times10^3$ rpm, and heated to 75° C. to react for 3 hours. Next, to the resulting reaction mixture, 30 parts of 1% by mass ammonium persulfate aqueous solution was added, and the resultant was matured for 12 hours at 65° C., to thereby obtain Vinyl Resin Dispersion Liquid 3. The volume average particle diameter of Vinyl Resin Dispersion Liquid 3 was measured by a laser diffraction/scattering particle analyzer (LA-920, manufactured by Horiba, Ltd.), and the volume average particle diameter thereof was 640 nm. Moreover, the vinyl resin contained in Vinyl Resin Dispersion Liquid 3 was separated and subjected to the measurement. As a result, it was found that the glass transition temperature of the vinyl resin was 59° C., and the weight average molecular weight thereof was $1.2\times10^5$.

[Preparation of Vinyl Resin Dispersion Liquid 4]

A reaction vessel equipped with a stirring rod and a thermometer was charged with 683 parts of ion-exchanged water, 11 parts of a sodium salt of sulfuric acid ester of methacrylic acid-ethylene oxide adduct (ELEMINOL RS-30, manufactured by Sanyo Chemical Industries, Ltd.), 10 parts of polylactic acid, 70 parts of styrene, 90 parts of methacrylic acid, 60 parts of butyl acrylate, and 1 part of ammonium persulfate, the mixture was then stirred for 30 minutes at $3.8\times10^3$ rpm, and heated to 75° C. to react for 3 hours. Next, to the resulting reaction mixture, 30 parts of 1% by mass ammonium persulfate aqueous solution was added, and the resultant was matured for 6 hours at 75° C., to thereby obtain Vinyl Resin Dispersion Liquid 4. The volume average particle diameter of Vinyl Resin Dispersion Liquid 4 was measured by a laser diffraction/scattering particle analyzer (LA-920, manufactured by Horiba, Ltd.), and the volume average particle diameter thereof was 153 nm. Moreover, the vinyl resin contained in Vinyl Resin Dispersion Liquid 4 was separated and subjected to the measurement. As a result, it was found that the glass transition temperature of the vinyl resin was 59° C., and the weight average molecular weight thereof was $1.5\times10^5$.

[Preparation of Vinyl Resin Dispersion Liquid 5]

A reaction vessel equipped with a stirring rod and a thermometer was charged with 683 parts of ion-exchanged water, 11 parts of a sodium salt of sulfuric acid ester of methacrylic acid-ethylene oxide adduct (ELEMINOL RS-30, manufactured by Sanyo Chemical Industries, Ltd.), 10 parts of polylactic acid, 70 parts of styrene, 90 parts of methacrylic acid, 60 parts of butyl acrylate, and 1 part of ammonium persulfate, the mixture was then stirred for 30 minutes at $4.3\times10^3$ rpm, and heated to 75° C. to react for 4 hours. Next, to the resulting reaction mixture, 30 parts of 1% by mass ammonium persulfate aqueous solution was added, and the resultant was matured for 6 hours at 75° C., to thereby obtain Vinyl Resin Dispersion Liquid 5. The volume average particle diameter of Vinyl Resin Dispersion Liquid 5 was measured by a laser diffraction/scattering particle analyzer (LA-920, manufactured by Horiba, Ltd.), and the volume average particle diameter thereof was 105 nm. Moreover, the vinyl resin contained in Vinyl Resin Dispersion Liquid 5 was separated and subjected to the measurement. As a result, it was found that the glass transition temperature of the vinyl resin was 58° C., and the weight average molecular weight thereof was $1.4\times10^5$.

[Preparation of Vinyl Resin Dispersion Liquid 6]

A reaction vessel equipped with a stirring rod and a thermometer was charged with 683 parts of ion-exchanged water, 11 parts of a sodium salt of sulfuric acid ester of methacrylic acid-ethylene oxide adduct (ELEMINOL RS-30, manufactured by Sanyo Chemical Industries, Ltd.), 10 parts of polylactic acid, 60 parts of styrene, 100 parts of methacrylic acid, 70 parts of butyl acrylate, and 1 part of ammonium persulfate, the mixture was then stirred for 20 minutes at $1.5\times10^3$ rpm, and heated to 75° C. to react for 3 hours. Next, to the resulting reaction mixture, 30 parts of 1% by mass ammonium persulfate aqueous solution was added, and the resultant was matured for 12 hours at 65° C., to thereby obtain Vinyl Resin Dispersion Liquid 6. The volume average particle diameter of Vinyl Resin Dispersion Liquid 6 was measured by a laser diffraction/scattering particle analyzer (LA-920, manufactured by Horiba, Ltd.), and the volume average particle diameter thereof was 720 nm. Moreover, the vinyl resin contained in Vinyl Resin Dispersion Liquid 6 was separated and subjected to the measurement. As a result, it was found that the glass transition temperature of the vinyl resin was 57° C., and the weight average molecular weight thereof was $1.2\times10^5$.

[Preparation of Vinyl Resin Dispersion Liquid 7]

In a reaction vessel equipped with a stirring rod and a thermometer, a mixture containing 200 parts of styrene, 120 parts of methyl methacrylate, 40 parts of n-butyl acrylate, 4 parts of acrylic acid, 24 parts of dodecanthiol, and 4 parts of carbon tetrabromide was emulsified with an aqueous solution in which 6 parts of a nonionic surfactant (NONIPOL 400, manufactured by Sanyo Chemical Industries, Ltd.) and 10 parts of anionic surfactant (Neogen SC, manufactured by Dai-Ichi Kogyo Seiyaku Co., Ltd.) were dissolved in 560 parts of ion-exchanged water. To the resultant an aqueous solution in which 4 parts of ammonium persulfate was dissolved in 50 parts of ion-exchanged water. After replacing the inner atmosphere of the reaction vessel with nitrogen under reduced pressure, the mixture was heated to 70° C. to react for 5 hours, to thereby obtain Vinyl Resin Dispersion Liquid 7. The volume average particle diameter of Vinyl Resin Dispersion Liquid 7 was measured by a laser diffraction/scattering particle analyzer (LA-920, manufactured by Horiba, Ltd.), and the volume average particle diameter thereof was 180 nm. Moreover, the vinyl resin contained in Vinyl Resin Dispersion Liquid 7 was separated and subjected to the measurement. As a result, it was found that the glass transition temperature of the vinyl resin was 73° C., and the weight average molecular weight thereof was $1.5\times10^4$. Moreover, vinyl resin dispersion liquid 7 had the solids content of 40% by mass.

[Preparation of Vinyl Resin Dispersion Liquid 8]

A reaction vessel equipped with a stirring rod and a thermometer was charged with 683 parts of ion-exchanged water, 11 parts of a sodium salt of sulfuric acid ester of methacrylic acid-ethylene oxide adduct (ELEMINOL RS-30, manufactured by Sanyo Chemical Industries, Ltd.), 10 parts of polylactic acid, 65 parts of styrene, 95 parts of methacrylic acid, 65 parts of butyl acrylate, and 1 part of ammonium persulfate, the mixture was then stirred for 30 minutes at $3.8\times10^3$ rpm, and heated to 75° C. to react for 3 hours. Next, to the resulting reaction mixture, 30 parts of 1% by mass ammonium persulfate aqueous solution was added, and the resultant was matured for 6 hours at 75° C., to thereby obtain Vinyl Resin Dispersion Liquid 8. The volume average particle diameter of Vinyl Resin Dispersion Liquid 8 was measured by a laser diffraction/scattering particle analyzer (LA-920, manufactured by Horiba, Ltd.), and the volume average particle diameter thereof was 124 nm. Moreover, the vinyl resin contained in Vinyl Resin Dispersion Liquid 8 was separated and subjected to the measurement. As a result, it was found that the glass transition temperature of the vinyl resin was 60° C., and the weight average molecular weight thereof was $1.6\times10^5$.

[Synthesis of Non-Crystalline Polyester 1]

A reaction vessel equipped with a cooling pipe, a stirrer, and a nitrogen introducing pipe was charged with 229 parts of bisphenol A ethylene oxide 2 mol adduct, 339 parts of bisphenol A propylene oxide 3 mol adduct, 208 parts of terephthalic acid, 80 parts of adipic acid, 10 parts of succinic acid, and 2 parts of dibutyl tin oxide. The mixture was allowed to react for 5 hours at 230° C. under normal pressure, and further reacted for another 5 hours under reduced pressure of 10 mmHg to 15 mmHg. To this, 35 parts of trimellitic anhydride was added, and the mixture was allowed to react for 1 hour at 180° C. under normal pressure, to thereby obtain Non-Crystalline Polyester 1. Non-Crystalline Polyester 1 had the number average molecular weight of $1.8\times10^3$, the weight average molecular weight of $3.5\times10^3$, the glass transition temperature of 38° C., and the acid value of 25 mgKOH/g.

[Synthesis of Non-Crystalline Polyester 2]

A reaction vessel equipped with a cooling pipe, a stirrer, and a nitrogen introducing pipe was charged with 430 parts of bisphenol A ethylene oxide 2 mol adduct, 300 parts of bisphenol A propylene oxide 3 mol adduct, 257 parts of terephthalic acid, 65 parts of isophthalic acid, 10 parts of maleic anhydride, and 2 parts of dihydroxybis(triethanol aminato)titanium. The mixture was allowed to react for 8 hours at 220° C. with stream of nitrogen gas, and further reacted under reduced pressure of 5 mmHg to 20 mmHg until the acid value thereof reached 7 mgKOH/g. The resultant was taken out, and cooled down to room temperature, followed by subjected to pulverization to thereby obtain Non-Crystalline Polyester 2. Non-Crystalline Polyester 2 had the number average molecular weight of $6.2\times10^3$, the weight average molecular weight of $2.56\times10^4$, the glass transition temperature of 59° C., and the acid value of 8 mgKOH/g.

[Synthesis of Non-Crystalline Polyester 3]

A reaction vessel equipped with a cooling pipe, a stirrer, and a nitrogen introducing pipe was charged with 350 parts of bisphenol A ethylene oxide 2 mol adduct, 326 parts of bisphenol A propylene oxide 3 mol adduct, 278 parts of terephthalic acid, 40 parts of phthalic anhydride, and 2 parts of dihydroxybis(triethanol aminato)titanium. The mixture was allowed to react for 8 hours at 220° C. with stream of nitrogen gas, and further reacted under reduced pressure of 5 mmHg to 20 mmHg until the acid value thereof became 2 mgKOH/g or lower. The resultant was cooled down to 180° C., and to this, 62 parts of trimellitic anhydride was added, and the mixture was allowed to react for 2 hours in the sealed vessel under normal pressure. The resultant was taken out, and cooled down to room temperature, followed by subjected to pulverization, to thereby obtain Non-Crystalline Polyester 3. Non-Crystalline Polyester 3 had the number average molecular weight of $4.2\times10^3$, the weight average molecular weight of $9.38\times10^4$, the glass transition temperature of 68° C., and the acid value of 35 mgKOH/g.

[Synthesis of Non-Crystalline Polyester 4]

A reaction vessel equipped with a cooling pipe, a stirrer, and a nitrogen introducing pipe was charged with 229 parts of bisphenol A ethylene oxide 2 mol adduct, 329 parts of bisphenol A propylene oxide 3 mol adduct, 208 parts of terephthalic acid, 80 parts of adipic acid, and 2 parts of dibutyl tin oxide. The mixture was allowed to react for 7 hours at 230° C. under normal pressure, and further reacted for another 5 hours under reduced pressure of 10 mmHg to 15 mmHg. To the resultant, 35 parts of trimellitic anhydride was added, and the mixture was allowed to react for 2 hours at 180° C. under normal pressure, to thereby obtain Non-Crystalline Polyester 4. Non-Crystalline Polyester 4 had the number average molecular weight of $2.0\times10^3$, the weight average molecular weight of $3.8\times10^3$, the glass transition temperature of 40° C., and the acid value of 25 mgKOH/g.

[Synthesis of Non-Crystalline Polyester 5]

A reaction vessel equipped with a cooling pipe, a stirrer, and a nitrogen introducing pipe was charged with 60 mol of bisphenol A ethylene oxide 2 mol adduct, 40 mol of ethylene glycol, 50 mol of terephthalic acid, and 50 mol of isophthalic acid. After replacing the internal atmosphere of the reaction vessel with nitrogen under reduced pressure, 0.04 mol of dibutyl tin oxide was added, and the mixture was allowed to react for 6 hours at 195° C. with stream of nitrogen gas. Next, the resultant was heated to 240° C. and allowed to react for 6 hours, followed by further reacting for 30 minutes under the reduced pressure of 10 mmHg, to thereby obtain Non-Crystalline Polyester 5. Non-Crystalline Polyester 5 had the number average molecular weight of $5.0\times10^3$, the weight average molecular weight of $1.9\times10^4$, the glass transition temperature of 64° C., and the acid value of 16 mgKOH/g.

[Synthesis of Prepolymer 1]

A reaction vessel equipped with a condenser, a stirrer and a nitrogen-introducing pipe was charged with 682 parts of bisphenol A ethylene oxide 2 mol adduct, 81 parts of bisphenol A propylene oxide 2 mol adduct, 283 parts of terephthalic acid, 22 parts by mass of trimellitic anhydride and 2 parts of dibutyl tin oxide. The resultant mixture was allowed to react for 7 hours at 230° C. under normal pressure, and further react for 5 hours at a reduced pressure of 10 mmHg to 15 mmHg, to obtain Hydroxyl Group-Containing Polyester 1. Hydroxyl Group-Containing Polyester 1 had the number average molecular weight of $2.2\times10^3$, the weight average molecular weight of $9.7\times10^3$, the glass transition temperature of 54° C., the acid value of 0.5 mgKOH/g, and the hydroxyl value of 52 mgKOH/g.

Next, a reaction vessel equipped with a condenser, a stirrer and a nitrogen-introducing pipe was charged with 410 parts of Hydroxyl Group-Containing Polyester 1, 89 parts of isophorone diisocyanate and 500 parts of ethyl acetate, and the mixture was allowed to react for 5 hours at 100° C., to thereby obtain Prepolymer 1. The amount of free isocyanate contained in Prepolymer 1 was 1.53% by mass.

[Synthesis of Ketimine 1]

A reaction vessel equipped with a stirring rod and a thermometer was charged with 170 parts of isophorone diisocyanate and 75 parts of methyl ethyl ketone, and the mixture was allowed to react for four and a half hours at 50° C., to thereby obtain Ketimine 1. Ketimine 1 had the amine value of 417 mgKOH/g.

[Synthesis of Crystalline Polyester 1]

A reaction vessel equipped with a condenser, a stirrer and a nitrogen-introducing pipe was charged with 1,200 parts of 1,6-hexanediol, 1,200 parts of 1,12-dodecane dicarboxylic acid, and 0.4 parts of dibutyl tin oxide, and the internal atmosphere of the reaction vessel was replaced with nitrogen under the reduced pressure, and the mixture was stirred by the stirrer for 5 hours at 180 rpm. Then, the resultant was heated at 220° C. under the reduced pressure, and stirred for 2 hours. The stirring was stopped when the mixture turned into a viscous state, and air-cooled to terminate the reaction, to thereby obtain Crystalline Polyester 1. Crystalline Polyester 1 had the number average molecular weight of $3.7\times10^3$, the weight average molecular weight of $1.6\times10^4$, and the melting point of 69° C.

[Synthesis of Crystalline Polyester 2]

A reaction vessel equipped with a condenser, a stirrer and a nitrogen-introducing pipe was charged with 124 parts of ethylene glycol, 22.2 parts of sodium dimethyl-5-sulfoisophthalate, 213 parts of dimethyl sebacate, and 0.3 parts of dibutyl tin oxide, and the internal atmosphere of the reaction vessel was replaced with nitrogen under the reduced pressure, and the mixture was stirred by the stirrer for 5 hours at 180° C. Then, the resultant was heated at 220° C. under the reduced pressure, and stirred for 2 hours. The stirring was stopped when the mixture turned into a viscous state, and air-cooled to terminate the reaction, to thereby obtain Crystalline Polyester 2. Crystalline Polyester 2 had the number average molecular weight of $5.4\times10^3$, the weight average molecular weight of $9.7\times10^3$, and the melting point of 60° C.

[Non-Crystalline Polyester Dispersion Liquid 1]

Ion-exchanged water (80 parts) and Non-Crystalline Polyester 5 (20 parts) were mixed, and pH of the mixture was adjusted to 8.5 with ammonia. The resultant was dispersed with a disperser which was a high temperature high pressure disperser modified from CAVITRON CD1010 (manufactured by EUROTEC CO., LTD.), at the rotator's rotational speed of 60 Hz, the pressure of 5 kgf/cm$^2$, and the heating temperature (by a heat exchanger) of 140° C., to thereby obtain Non-Crystalline Polyester Dispersion Liquid 1. The volume average particle diameter of Non-Crystalline Polyester Dispersion Liquid 1 was measured by a laser diffraction/scattering particle size analyzer (LA-920, manufactured by HORIBA, Ltd.), and it was 150 nm. Moreover, Non-Crystalline Polyester Dispersion Liquid 1 had solids content of 30% by mass.

[Non-Crystalline Polyester Dispersion Liquid 2]

Ion-exchanged water (80 parts) and Non-Crystalline Polyester 2 (20 parts) were mixed, and pH of the mixture was adjusted to 8.5 with ammonia. The resultant was dispersed with a disperser which was a high temperature high pressure disperser modified from CAVITRON CD1010 (manufactured by EUROTEC CO., LTD.), at the rotator's rotational speed of 60 Hz, the pressure of 5 kgf/cm$^2$, and the heating temperature (by a heat exchanger) of 140° C., to thereby obtain Non-Crystalline Polyester Dispersion Liquid 2. The volume average particle diameter of Non-Crystalline Polyester Dispersion Liquid 2 was measured by a laser diffraction/scattering particle size analyzer (LA-920, manufactured by HORIBA, Ltd.), and it was 201 nm. Moreover, Non-Crystalline Polyester Dispersion Liquid 2 had solids content of 30% by mass.

[Non-Crystalline Polyester Dispersion Liquid 3]

Ion-exchanged water (80 parts) and Non-Crystalline Polyester 2 (20 parts) were mixed, and pH of the mixture was adjusted to 8.5 with ammonia. The resultant was dispersed with a disperser which was a high temperature high pressure disperser modified from CAVITRON CD1010 (manufactured by EUROTEC CO., LTD.), at the rotator's rotational speed of 60 Hz, the pressure of 4 kgf/cm$^2$, and the heating temperature (by a heat exchanger) of 140° C., to thereby obtain Non-Crystalline Polyester Dispersion Liquid 3. The volume average particle diameter of Non-Crystalline Polyester Dispersion Liquid 3 was measured by a laser diffraction/scattering particle size analyzer (LA-920, manufactured by HORIBA, Ltd.), and it was 293 nm. Moreover, Non-Crystalline Polyester Dispersion Liquid 3 had solids content of 30% by mass.

[Non-Crystalline Polyester Dispersion Liquid 4]

Ion-exchanged water (80 parts) and Non-Crystalline Polyester 5 (20 parts) were mixed, and pH of the mixture was adjusted to 8.5 with ammonia. The resultant was dispersed with a disperser which was a high temperature high pressure disperser modified from CAVITRON CD1010 (manufactured by EUROTEC CO., LTD.), at the rotator's rotational speed of 60 Hz, the pressure of 6 kgf/cm$^2$, and the heating temperature (by a heat exchanger) of 140° C., to thereby obtain Non-Crystalline Polyester Dispersion Liquid 4. The volume average particle diameter of Non-Crystalline Polyester Dispersion Liquid 4 was measured by a laser diffraction/scattering particle size analyzer (LA-920, manufactured by HORIBA, Ltd.), and it was 103 nm. Moreover, Non-Crystalline Polyester Dispersion Liquid 4 had solids content of 30% by mass.

[Non-Crystalline Polyester Dispersion Liquid 5]

Ion-exchanged water (80 parts) and Non-Crystalline Polyester 5 (20 parts) were mixed, and pH of the mixture was adjusted to 8.5 with ammonia. The resultant was dispersed with a disperser which was a high temperature high pressure disperser modified from CAVITRON CD1010 (manufactured by EUROTEC CO., LTD.), at the rotator's rotational speed of 60 Hz, the pressure of 5.5 kgf/cm$^2$, and the heating temperature (by a heat exchanger) of 140° C., to thereby obtain Non-Crystalline Polyester Dispersion Liquid 5. The volume average particle diameter of Non-Crystalline Polyester Dispersion Liquid 5 was measured by a laser diffraction/scattering particle size analyzer (LA-920, manufactured by HORIBA, Ltd.), and it was 122 nm. Moreover, Non-Crystalline Polyester Dispersion Liquid 5 had solids content of 30% by mass.

Example 1

Ion-exchanged water (990 parts), Vinyl Resin Dispersion Liquid 1 (83 parts), a 48.3% by mass sodium dodecyldiphenyl ether sulfonate aqueous solution (ELEMINOL MON-7, manufactured by Sanyo Chemical Industries, Ltd.) (37 parts) and ethyl acetate (90 parts) were mixed together and stirred to thereby obtain Aqueous Medium 1.

Ion-exchanged water (1,200 parts), carbon black Printex 35, product of Degussa) [DBP oil absorption amount=42 mL/100 mg, pH=9.5] (540 parts), and Non-Crystalline Polyester 1 (1,200 parts) were mixed by HENSCHEL MIXER (product of Mitsui Mining Co., Ltd). The resulting mixture was kneaded for 1 hour at 110° C. with a two-roll mill, and then rolled, cooled and pulverized with a pulverizer, to thereby produce Master Batch 1.

A vessel equipped with a stirring rod and a thermometer was charged with 378 parts of Non-Crystalline Polyester Resin 1, 120 parts of paraffin wax (melting point: 90° C.), 200 parts of Crystalline Polyester 1, and 947 parts of ethyl acetate, and the resulting mixture was heated to 80° C. with stirring. The resulting mixture was maintained its temperature at 80° C. for 5 hours, and then cooled to 30° C. over 1 hour. To the resultant, 500 parts of Master Batch 1, and 500 parts of ethyl acetate were added, and the resulting mixture was mixed for 1 hour. The obtained mixed solution (1,324 parts) was poured into a vessel, and then dispersed with a bead mill (ULTRA VISCOMILL, manufactured by AIMEX CO., Ltd.) under the following conditions: a liquid feed rate of 1 kg/hr, disc circumferential velocity of 6 m/s, 0.5 mm-zirconium beads packed to 80% by volume, and 3 passes. Next, a 65% by mass ethyl acetate solution of Non-Crystalline Polyester 1 (1,324 parts) was added thereto, and dispersed with the bead mill (ULTRA VISCOMILL, manufactured by AIMEX CO., Ltd.) under the above conditions for twice (two passes), to thereby obtain Dispersion Liquid 1. Dispersion Liquid 1 was dried for 30 minutes at 130° C., and it was found that the solids content thereof was 50% by mass.

A vessel was charged with 749 parts of Dispersion Liquid 1, 120 parts of Prepolymer 1, and 3.5 parts of Ketimine 1, and the resulting mixture was mixed by TK homomixer (manufactured by Tokushu Kika Kogyo Co., Ltd.) for 5 minutes at $5\times10^3$ rpm. To the resultant, 1,200 parts of Aqueous Medium 1 was added, the resulting mixture was mixed by TK homomixer for 1.5 hours at $1\times10^4$ rpm, to thereby obtain Emulsified Slurry 1.

A vessel equipped with a stirrer and a thermometer was charged with Emulsified Slurry 1, followed by removing the solvent from the Emulsified Slurry 1 for 8 hours at 30° C. and aging for 72 hours at 40° C., to thereby produce Dispersion Slurry 1.

After filtering 100 parts of Dispersion Slurry 1 under reduced pressure, 100 parts of ion-exchanged water was added to the filtration cake, and the mixture was mixed with a TK homomixer for 10 minutes at $1.2\times10^4$ rpm, followed by filtration. To the obtained filtration cake, 100 parts of a 10% by mass sodium hydroxide aqueous solution was added, and the mixture was mixed with a TK homomixer for 30 minutes at $1.2\times10^4$ rpm, followed by filtration under reduced pressure. To the obtained filtration cake, 100 parts of 10% by mass hydrochloric acid was added, and the mixture was mixed by a TK homomixer for 10 minutes at $1.2\times10^4$ rpm, followed by filtration. To the obtained filtration cake, 300 parts of ion-exchanged water was added, and the mixture was mixed by a TK homomixer for 10 minutes at $1.2\times10^4$ rpm, followed by filtration, and this procedure was performed twice in total, to thereby obtain a filtration cake.

The obtained filtration cake was dried with an air-circulating drier for 48 hours at 45° C., and was then subjected to classification with a sieve with a mesh size of 75 μm, to thereby obtain base particles.

To 100 parts of the obtained base particles, 1 part of hydrophobic processed silica (the average primary diameter: 13 nm), and the resultant was mixed by HENSCHEL MIXER, to thereby obtain a toner.

Example 2

A toner was obtained in the same manner as in Example 1, provided that Vinyl Resin Dispersion Liquid 1 was replaced with Vinyl Resin Dispersion Liquid 2.

Example 3

A toner was obtained in the same manner as in Example 1, provided that Vinyl Resin Dispersion Liquid 1 and Non-Crystalline Polyester 1 were replaced with Vinyl Resin Dispersion Liquid 3, and Non-Crystalline Polyester 2, respectively.

Example 4

Ion-exchanged water (1,013 parts), Vinyl Resin Dispersion Liquid 1 (60 parts), 48.3% by mass sodium dodecyldiphenyl ether sulfonate aqueous solution (ELEMINOL MON-7, manufactured by Sanyo Chemical Industries, Ltd.) (37 parts), and ethyl acetate (90 parts) were mixed and stirred to thereby obtain Aqueous Medium 2.

A toner was obtained in the same manner as in Example 1, provided that Aqueous Medium 1 and Non-Crystalline Polyester 1 were replaced with Aqueous Medium 2 and Non-Crystalline Polyester 2, respectively.

Example 5

A toner was obtained in the same manner as in Example 1, provided that Vinyl Resin Dispersion Liquid 1 was replaced with Vinyl Resin Dispersion Liquid 4.

Example 6

A toner was obtained in the same manner as in Example 1, provided that Prepolymer 1 and Ketimine 1 were not used.

Comparative Example 1

A toner was obtained in the same manner as in Example 1, provided that Vinyl Resin Dispersion Liquid 1 was replaced with Vinyl Resin Dispersion Liquid 5. The based particles of the obtained toner did not have core-shell structures.

Comparative Example 2

Ion-exchanged water (1,013 parts), Vinyl Resin Dispersion Liquid 1 (60 parts), 48.3% by mass sodium dodecyldiphenyl ether sulfonate aqueous solution (ELEMINOL MON-7, manufactured by Sanyo Chemical Industries, Ltd.) (37 parts), and ethyl acetate (90 parts) were mixed and stirred to thereby obtain Aqueous Medium 2.

A toner was obtained in the same manner as in Example 1, provided that Aqueous Medium 1 was replaced with Aqueous Medium 2.

Comparative Example 3

A toner was obtained in the same manner as in Example 1, provided that Vinyl Resin Dispersion Liquid 1 was replaced with Vinyl Resin Dispersion Liquid 6.

Comparative Example 4

A toner was obtained in the same manner as in Example 1, provided that Non-Crystalline Polyester 1 was replaced with Non-Crystalline Polyester 3.

Comparative Example 5

Ion-exchanged water (1,013 parts), Vinyl Resin Dispersion Liquid 1 (110 parts), 48.3% by mass sodium dodecyldiphenyl ether sulfonate aqueous solution (ELEMINOL MON-7, manufactured by Sanyo Chemical Industries, Ltd.) (37 parts), and ethyl acetate (90 parts) were mixed and stirred to thereby obtain Aqueous Medium 3.

A toner was obtained in the same manner as in Example 1, provided that Aqueous Medium 1 and Non-Crystalline Polyester 1 were replaced with Aqueous Medium 3 and Non-Crystalline Polyester 4, respectively.

Comparative Example 6

Ion-exchanged water (1,013 parts), Vinyl Resin Dispersion Liquid 1 (60 parts), 48.3% by mass sodium dodecyldiphenyl ether sulfonate aqueous solution (ELEMINOL MON-7, manufactured by Sanyo Chemical Industries, Ltd.) (37 parts), and ethyl acetate (90 parts) were mixed and stirred to thereby obtain Aqueous Medium 2.

A toner was obtained in the same manner as in Example 1, provided that Aqueous Medium 1 and Non-Crystalline Polyester 1 were replaced with Aqueous Medium 2 and Non-Crystalline Polyester 4.

Comparative Example 7

Ion-exchanged water (850 parts) and Crystalline Polyester 2 (150 parts) were mixed, and the mixture was heated to 85° C., followed by dispersing by a homogenizer (ULTRA-TRUUAX, of IKA Japan), to thereby obtain Crystalline Polyester Dispersion Liquid 1.

Ion-exchanged water (80 parts) and Non-Crystalline Polyester 5 (20 parts) were mixed, and pH of the mixture was adjusted to 8.5 with ammonia. The resultant was dispersed with a disperser which was a high temperature high pressure disperser modified from CAVITRON CD1010 (manufactured by EUROTEC CO., LTD.), at the rotator's rotational speed of 60 Hz, the pressure of 5 kgf/cm$^2$, and the heating temperature (by a heat exchanger) of 140° C., to thereby obtain Non-Crystalline Polyester Dispersion Liquid 1. The volume average particle diameter of Non-Crystalline Polyester Dispersion Liquid 1 was measured by a laser diffraction/scattering particle size analyzer (LA-920, manufactured by HORIBA, Ltd.), and it was 150 nm. Moreover, Non-Crystalline Polyester Dispersion Liquid 1 had solids content of 30% by mass.

After mixing 250 parts of a cyan pigment (ECB-301, manufactured by Dainichiseika Color and Chemicals Mfg. Co., Ltd.), 20 parts of an anionic surfactant (Neogen RK, manufactured by Dai-Ichi Kogyo Seiyaku Co., Ltd.), and 730 parts of ion-exchanged water, the resulting mixture was dispersed by a homogenizer (ULTRA-TRUUAX, of IKA Japan), to thereby obtain Colorant Dispersion Liquid 1.

After mixing 350 parts of paraffin wax (melting point: 90° C.), 15 parts of an anionic surfactant (Neogen RK, manufactured by Dai-Ichi Kogyo Seiyaku Co., Ltd.), and 635 parts of ion-exchanged water, the resulting mixture was heated to 90° C. The resultant was dispersed by a homogenizer (ULTRA-TRUUAX, of IKA Japan), to thereby obtain Releasing Agent Dispersion Liquid 1.

A stainless steel rounded flask was charged with 680 parts of Crystalline Polyester Dispersion Liquid 1, 340 parts of Non-Crystalline Polyester Dispersion Liquid 1, 120 parts of a dispersion liquid of a non-crystalline polyester having the glass transition temperature of 61.7° C., weight average molecular weight of $1.8\times10^3$, and number average molecular weight of $1.4\times10^3$ (Super Ester NS100H, manufactured by Arakawa Chemical Industries, Ltd.), 52 parts of Colorant Dispersion Liquid 1, and 66 parts of Releasing Agent Dispersion Liquid 1. To the resulting mixture, 5 parts of calcium chloride (manufactured by Wako Pure Chemical Industries, Ltd.), 650 parts of ion-exchanged water, and 340 parts of Non-Crystalline Polyester Dispersion Liquid 1 were added. Then, the resulting mixture was heated to 60° C., and maintained its temperature at 60° C. for 3 hours. The resultant was observed under an optical microscope and then it was confirmed that aggregated particles having the volume average particle diameter of 5 μm were formed therein. The resultant was maintained its temperature at 60° C. for another 1 hour, and then was observed under an optical microscope. It was confirmed that aggregated particles having the volume average particle diameter of 5.5 μm were formed therein.

Since the pH of the obtained dispersion liquid of aggregated particles was 3.8, the pH thereof was adjusted to 5.0 using a 0.5% by mass sodium carbonate aqueous solution (manufactured by Wako Pure Chemical Industries, Ltd.). The obtained dispersion liquid of aggregated particles was heated to 80° C., and maintained its temperature at 80° C. for 30 minutes.

The resultant was observed under an optical microscope, and it was confirmed that combined spherical particles were formed therein. Then, the resultant was cooled to 30° C. at the rate of 1° C./min by adding ion-exchanged water, followed by subjected to filtration. Then, the resultant was washed with 2,000 parts of ion-exchanged water, followed by subjected to filtration, to thereby obtained Core Dispersion Liquid 1. Core Dispersion Liquid 1 had solids content of 50% by mass.

A flask was charged with 560 parts of Core Dispersion Liquid 1. To this, 100 parts of Vinyl Resin Dispersion Liquid 7 was added, and ion-exchanged water was added to adjust the solids content thereof to 35% by mass. To the resultant, a 0.3 mol/L nitric acid aqueous solution was added to adjust the pH thereof to 3.0, and then 0.28 parts of aluminum polychloride was added thereto. The resulting mixture was heated to 48° C. at the rate of 0.5° C./min, and maintained its temperature at 48° C. for 2 hours. The resultant was further heated to 57° C. at the rate of 0.1° C./min. Since the pH thereof was 7.3, a 0.5 mol/L sodium hydroxide aqueous solution was used to adjust the pH thereof to 7.5, and then the resultant was maintained its temperature at 57° C. for 10 hours. After observing the resultant under a scanning electron microscope, and confirming that a shell was formed on the surface of the core, the resultant was cooled to 20° C. over 30 minutes. Then, the resultant was subjected to filtration, washed with ion-exchanged water, and dried by a vacuum dryer, to thereby obtain base particles.

The obtained base particles (100 parts) and hydrophobic-treated silica having the average primary diameter of 13 nm (1 part) were mixed by means of HENSCHEL MIXER to thereby obtain a toner.

Example 7

A toner was obtained in the same manner as in Example 1, provided that Vinyl Resin Dispersion Liquid 1 was replaced with Vinyl Resin Dispersion Liquid 8.

Example 8

A toner was obtained in the same manner as in Example 1, provided that 120 parts of Prepolymer 1 and 3.5 parts of Ketimine 1 were replaced with 120 parts of Non-Crystalline Polyester 3.

Example 9

A toner was obtained in the same manner as in Example 2, provided that 120 parts of Prepolymer 1 and 3.5 parts of Ketimine 1 were replaced with 120 parts of Non-Crystalline Polyester 3.

Example 10

A toner was obtained in the same manner as in Example 3, provided that 120 parts of Prepolymer 1 and 3.5 parts of Ketimine 1 were replaced with 120 parts of Non-Crystalline Polyester 3.

Example 11

A toner was obtained in the same manner as in Example 4, provided that 120 parts of Prepolymer 1 and 3.5 parts of Ketimine 1 were replaced with 120 parts of Non-Crystalline Polyester 3.

Example 12

A toner was obtained in the same manner as in Example 5, provided that 120 parts of Prepolymer 1 and 3.5 parts of Ketimine 1 were replaced with 120 parts of Non-Crystalline Polyester 3.

Example 13

A toner was obtained in the same manner as in Example 6, provided that 120 parts of Prepolymer 1 and 3.5 parts of Ketimine 1 were replaced with 120 parts of Non-Crystalline Polyester 3.

Example 14

A toner was obtained in the same manner as in Example 7, provided that 120 parts of Prepolymer 1 and 3.5 parts of Ketimine 1 were replaced with 120 parts of Non-Crystalline Polyester 3.

Example 15

A toner was obtained in the same manner as in Example 1, provided that Vinyl Resin Dispersion Liquid 1 was replaced with Non-Crystalline Polyester Dispersion Liquid 1.

Example 16

A toner was obtained in the same manner as in Example 1, provided that Vinyl Resin Dispersion Liquid 1 was replaced with Non-Crystalline Polyester Dispersion Liquid 2.

Example 17

A toner was obtained in the same manner as in Example 1, provided that Vinyl Resin Dispersion Liquid 1 was replaced with Non-Crystalline Polyester Dispersion Liquid 3.

Example 18

Ion-exchanged water (1,013 parts), Non-Crystalline Polyester Dispersion Liquid 1 (60 parts), 48.3% by mass sodium dodecyldiphenyl ether sulfonate aqueous solution (ELEMINOL MON-7, manufactured by Sanyo Chemical Industries, Ltd.) (37 parts), and ethyl acetate (90 parts) were mixed and stirred to thereby obtain Aqueous Medium 4.

A toner was obtained in the same manner as in Example 1, provided that Aqueous Medium 1 and Non-Crystalline Polyester 1 were replaced with Aqueous Medium 4 and Non-Crystalline Polyester 2, respectively.

Example 19

A toner was obtained in the same manner as in Example 1, provided that Vinyl Resin Dispersion Liquid 1 was replaced with Non-Crystalline Polyester Dispersion Liquid 4.

Example 20

A toner was obtained in the same manner as in Example 1, provided that Prepolymer 1 and Ketimine 1 were not used, and Vinyl Resin Dispersion Liquid 1 was replaced with Non-Crystalline Polyester Dispersion Liquid 1.

Example 21

A toner was obtained in the same manner as in Example 1, provided that Vinyl Resin Dispersion Liquid 1 was replaced with Non-Crystalline Polyester Dispersion Liquid 5.

Example 22

Ion-exchanged water (1,013 parts), Non-Crystalline Polyester Dispersion Liquid 2 (70 parts), 48.3% by mass sodium dodecyldiphenyl ether sulfonate aqueous solution (ELEMINOL MON-7, manufactured by Sanyo Chemical Industries, Ltd.) (37 parts), and ethyl acetate (90 parts) were mixed and stirred to thereby obtain Aqueous Medium 5.

A toner was obtained in the same manner as in Example 1, provided that Aqueous Medium 1 and Non-Crystalline Polyester 1 were replaced with Aqueous Medium 5 and Non-Crystalline Polyester 2, respectively.

Example 23

Ion-exchanged water (1,013 parts), Non-Crystalline Polyester Dispersion Liquid 4 (60 parts), 48.3% by mass sodium dodecyldiphenyl ether sulfonate aqueous solution (ELEMINOL MON-7, manufactured by Sanyo Chemical Industries, Ltd.) (37 parts), and ethyl acetate (90 parts) were mixed and stirred to thereby obtain Aqueous Medium 6.

A toner was obtained in the same manner as in Example 1, provided that Aqueous Medium 1 and Non-Crystalline Polyester 1 were replaced with Aqueous Medium 6 and Non-Crystalline Polyester 2, respectively.

Comparative Example 8

A toner was obtained in the same manner as in Example 1, provided that Vinyl Resin Dispersion Liquid 1 and Non-Crystalline Polyester 1 were replaced with Vinyl Resin Dispersion Liquid 8 and Non-Crystalline Polyester 3, respectively.

Comparative Example 9

Ion-exchanged water (1,013 parts), Vinyl Resin Dispersion Liquid 8 (110 parts), 48.3% by mass sodium dodecyldiphenyl ether sulfonate aqueous solution (ELEMINOL MON-7, manufactured by Sanyo Chemical Industries, Ltd.) (37 parts), and ethyl acetate (90 parts) were mixed and stirred to thereby obtain Aqueous Medium 7.

A toner was obtained in the same manner as in Example 1, provided that Aqueous Medium 1 was replaced with Aqueous Medium 7.

Comparative Example 10

A toner was obtained in the same manner as in Comparative Example 9, provided that the vessel equipped with the stirring rod and the thermometer was charged with Emulsified Slurry 1, and the solvent was removed from Emulsified Slurry 1 for 8 hours at 30° C., followed by maturing Emulsified Slurry 1 for 96 hours at 44° C.

Comparative Example 11

A toner was obtained in the same manner as in Example 1, provided that Vinyl Resin Dispersion Liquid 1 was replaced with Vinyl Resin Dispersion Liquid 8, and the vessel equipped with the stirring rod and the thermometer was charged with Emulsified Slurry 1, and the solvent was removed from Emulsified Slurry 1 for 8 hours at 30° C., followed by maturing Emulsified Slurry 1 for 96 hours at 44° C.

Properties of the obtained toners are depicted in Tables 1 and 2.

TABLE 1

| | St | Ct [° C.] | Ht [° C.] | Thickness of shell [μm] | Average circularity | SF-1 | SF-2 | $D_4$ [μm] | $D_4$/Dn |
|---|---|---|---|---|---|---|---|---|---|
| Ex. 1 | 1.4 | 87 | 39 | 0.6 | 0.96 | 130 | 125 | 4.5 | 1.07 |
| Ex. 2 | 1.6 | 86 | 33 | 1.1 | 0.94 | 152 | 140 | 4.4 | 1.13 |
| Ex. 3 | 1.8 | 95 | 50 | 1.8 | 0.98 | 118 | 112 | 3.2 | 1.19 |
| Ex. 4 | 0.7 | 93 | 45 | 0.2 | 0.95 | 130 | 129 | 4.8 | 1.14 |
| Ex. 5 | 0.5 | 80 | 30 | 0.6 | 0.96 | 131 | 124 | 4.1 | 1.06 |
| Ex. 6 | 1.2 | 80 | 31 | 0.6 | 0.95 | 131 | 126 | 4.6 | 1.12 |
| Comp. Ex. 1 | 0.4 | 87 | 20 | — | 0.98 | 118 | 112 | 4.9 | 1.20 |
| Comp. Ex. 2 | 0.4 | 88 | 29 | 0.5 | 0.97 | 132 | 124 | 5.1 | 1.19 |
| Comp. Ex. 3 | 1.9 | 96 | 51 | 2.0 | 0.94 | 155 | 136 | 5.4 | 1.26 |
| Comp. Ex. 4 | 1.5 | 97 | 54 | 0.7 | 0.94 | 152 | 141 | 7.1 | 1.20 |
| Comp. Ex. 5 | 0.5 | 83 | 27 | 0.4 | 0.95 | 150 | 132 | 5.1 | 1.19 |
| Comp. Ex. 6 | 0.7 | 86 | 28 | 0.6 | 0.96 | 144 | 131 | 6.1 | 1.27 |
| Comp. Ex. 7 | 0.6 | 85 | 29 | 0.8 | 0.96 | 133 | 143 | 5.8 | 1.14 |

TABLE 2

| | St | Ct [° C.] | Ht [° C.] | Thickness of shell [μm] | Average circularity | SF-1 | SF-2 | $D_4$ [μm] | $D_4$/Dn |
|---|---|---|---|---|---|---|---|---|---|
| Ex. 7 | 0.6 | 81 | 32 | 0.04 | 0.96 | 131 | 126 | 4.6 | 1.10 |
| Ex. 8 | 1.5 | 88 | 39 | 0.7 | 0.95 | 130 | 124 | 4.6 | 1.07 |
| Ex. 9 | 1.7 | 87 | 33 | 1.2 | 0.95 | 150 | 141 | 4.5 | 1.15 |
| Ex. 10 | 1.8 | 95 | 50 | 1.6 | 0.97 | 120 | 116 | 3.5 | 1.17 |
| Ex. 11 | 0.7 | 93 | 45 | 0.3 | 0.96 | 129 | 130 | 4.9 | 1.20 |
| Ex. 12 | 0.6 | 81 | 30 | 0.7 | 0.95 | 130 | 128 | 4.2 | 1.11 |
| Ex. 13 | 1.3 | 81 | 31 | 0.6 | 0.95 | 131 | 124 | 4.1 | 1.05 |
| Ex. 14 | 0.7 | 82 | 32 | 0.03 | 0.96 | 131 | 126 | 4.6 | 1.10 |
| Ex. 15 | 1.3 | 86 | 37 | 0.8 | 0.96 | 131 | 123 | 4.9 | 1.14 |
| Ex. 16 | 1.5 | 85 | 31 | 1.3 | 0.95 | 140 | 138 | 4.8 | 1.17 |
| Ex. 17 | 1.6 | 94 | 49 | 1.9 | 0.96 | 128 | 117 | 3.8 | 1.19 |
| Ex. 18 | 0.6 | 92 | 44 | 0.3 | 0.85 | 130 | 129 | 5.1 | 1.19 |
| Ex. 19 | 0.5 | 80 | 31 | 0.7 | 0.84 | 131 | 127 | 4.8 | 1.14 |
| Ex. 20 | 1.2 | 80 | 30 | 0.6 | 0.96 | 129 | 124 | 4.7 | 1.15 |
| Ex. 21 | 0.6 | 80 | 30 | 0.03 | 0.94 | 130 | 125 | 4.5 | 1.07 |
| Ex. 22 | 1.8 | 80 | 30 | 0.1 | 0.96 | 132 | 126 | 4.6 | 1.07 |
| Ex. 23 | 0.5 | 82 | 31 | 0.01 | 0.96 | 131 | 125 | 4.6 | 1.05 |
| Comp. Ex. 8 | 0.4 | 79 | 29 | 0.03 | 0.95 | 130 | 127 | 4.4 | 1.10 |
| Comp. Ex. 9 | 2.0 | 96 | 28 | 0.02 | 0.94 | 131 | 126 | 4.7 | 1.15 |
| Comp. Ex. 10 | 1.9 | 97 | 52 | 0.1 | 0.95 | 128 | 125 | 4.9 | 1.20 |
| Comp. Ex. 11 | 0.4 | 96 | 51 | 0.2 | 0.95 | 129 | 124 | 4.5 | 1.13 |

The evaluation methods of the properties of the toner are as described below.

(Thermal Hardness St, Softening Index Ct, and Thermal Retentiveness Ht)

The evaluation was performed with a flow tester CFT-500D (manufactured by Shimadzu Corporation). Specifically, 1 g of the toner was compression molded into a cylindrical shape having a diameter of 1 cm to thereby prepare a tablet toner T. Next, as illustrated in FIG. 4A, the tablet toner set in a cylinder C was preheated for 200 seconds to elevate its temperature to $T_s$ (50° C.). Then, a heating element H was heated to an outflow endset temperature $T_{end}$ at the rate of 3° C./min with applying a constant load (2 kgf to 25 kgf) by a plunger P, to thereby make the fused toner T' flow out from a die D. As illustrated in FIG. 4B, the lowered amount of the plunger P relative to the temperature of the heating element H was measured. Note that, the die used had a diameter of 0.5 mm, and a length of 1.0 mm.

(Thickness of Shell)

The toner was embedded in an epoxy-based resin and then the resin was cured. Thereafter, the shell and core were dyed for identification by exposing the toner embedded in the resin to ruthenium tetraoxide for 5 minutes. Next, the resin was sliced with a knife to expose the cross-section of the resin, and from the cut piece, an ultra-thin slice of the toner having a thickness of 200 nm was prepared using an ultramicrotome (ULTRACUT UCT, manufactured by Leica Microsystems). The prepared ultra-thin slice of the toner was observed with a transmission electron microscope (H7000, manufactured by Hitachi High-Technologies Corporation) at the acceleration voltage of 100 kV to thereby determine the thickness of the shell of the toner.

(Average Circularity)

The average circularity of the toner was measured with a flow, particle image analyzer FPIA-2100 and an analysis software FPIA-2100 Data Processing Program for FPIA version 00-10 (both manufactured Sysmex Corporation). Specifically, a 100 mL-glass beaker was charged with 0.1 mL to 0.5 mL of a 10% by mass surfactant (Neogen SC-A, manufactured by Dai-Ichi Kogyo Seiyaku Co., Ltd.), and 0.1 g to 0.5 g of the toner, and the mixture was stirred microspartel, followed by adding 80 mL of ion-exchanged water. The average circularity was measured with the obtained dispersion liquid having a concentration of 5,000 particles/μL to 15,000 particles/μL when dispersed with an ultrasonic wave disperser (manufactured by Honda Electronics Co., Ltd.) for 3 minutes.

(Shape Factors SF-1 and SF-2)

The shape factors SF-1 and SF-2 were calculated by sampling 300 toner particles, which has been randomly selected from a photograph taken by a field emission scanning microscope (S-4200, manufactured by Hitachi, Ltd.), sending the sampled image information to an image analyzer (Luzex AP, manufactured by NIRECO CORPORATION) via an interface, and analyze the information.

(Number Average Particle Diameter Dn and Weight Average Particle Diameter $D_4$)

The number average particle diameter Dn and weight average particle diameter were $D_4$ measured by Coulter Multisizer II (manufactured by Beckman Coulter, Inc.). Specifically, 0.1 mL to 5 mL of polyoxyethylene alkyl ether (a surfactant) was added to 100 mL to 150 mL of an electrolyte (ISOTON-II, of Beckman Coulter, Inc.). Next, to the resulting mixture, 2 mg to 20 mg of the toner was added, and the mixture was dispersed by means of an ultrasonic wave disperser for about 1 minute to about 3 minutes. The obtained sample dispersion liquid was subjected to the measurements of the number average particle diameter and weight average particle diameter with an aperture of 100 μm. Note that, as a channel, the following 13 channels were used: 2.00 μm or larger, but smaller than 2.52 μm; 2.52 μm or larger, but smaller than 3.17 μm; 3.17 μm or larger, but smaller than 4.00 μm; 4.00 μm or larger, but smaller than 5.04 μm; 5.04 μm or larger, but smaller than 6.35 μm; 6.35 μm or larger, but smaller than 8.00 μm; 8.00 μm or larger, but smaller than 10.08 μm; 10.08 μm or larger, but smaller than 12.70 μm; 12.70 μm or larger, but smaller than 16.00 μm; 16.00 μm or larger, but smaller than 20.20 μm; 20.20 μm or larger, but smaller than 25.40 μm; 25.40 μm or larger, but smaller than 32.00 μm; and 32.00 μm or larger, but smaller than 40.30 μm. The target particles for the measurement were particles having the diameters of 2.00 μm to 40.30 μm.

[Preparation of Carrier]

Toluene (450 parts), a silicone resin having solids content of 50% by mass (SR2400, manufactured by Dow Corning Toray Co., Ltd.) (450 parts), amino silane (SH6020, manufactured by Dow Corning Toray Co., Ltd.) (10 parts), and carbon black (10 parts) were dispersed for 10 minutes by a stirrer to thereby prepare a coating liquid for a coating layer. The obtained coating liquid for a coating layer and 5,000 parts of Mn ferrite having the weight average particle diameter of 35 μm were set in a coating device, which had a rotary base plate disk and a stirring blade in a fluid bed, and configured to perform coating with forming a swirling flow, and the Mn ferrite was coated with the coating liquid for a coating layer. Next, the resultant was baked by an electric furnace for 2 hours at 250° C., to thereby obtain a carrier whose particles each had the coating layer having the average thickness of 0.5 μm.

[Preparation of Developer]

The carrier (100 parts) and the toner (7 parts) were uniformly mixed by a turbular mixer configured to stir the contents in the vessel by the rolling motions of the vessel, to thereby charge the carrier and the toner. In the manner as mentioned, a developer was obtained.

[Evaluation 1 of Developer]

The developer was evaluated by means of a modified device of an image forming apparatus (imagio MP C6000, manufactured by Ricoh Company Limited) the fixing section of which had been modified. Specifically, the system speed was adjusted to 0.35 m/s. Moreover, the fixing unit in the fixing section was adjusted to press the recording medium bearing the transferred toner image at the beating of $4\times10^5$ Pa for 0.04 seconds. Note that, as a fixing roller, a roller prepared by applying a tetrafluoroethylene-perfluoroalkylvinyl ether copolymer (PFA) onto a surface of the roller, shaping, and adjusting the surface thereof, was used. Moreover, the heating temperature of the fixing roller was set at 140° C.

The evaluation results of the developers are depicted in Tables 3 and 4.

TABLE 3

| | Low temperature fixing ability | Inhibition of toner spent | Hot offset resistance |
|---|---|---|---|
| Example 1 | B | B | I |
| Example 2 | B | B | I |
| Example 3 | B | A | I |
| Example 4 | A | B | I |
| Example 5 | A | C | I |
| Example 6 | A | C | II |
| Comparative Example 1 | D | D | III |
| Comparative Example 2 | D | D | III |
| Comparative Example 3 | D | C | I |
| Comparative Example 4 | D | B | I |
| Comparative Example 5 | B | D | III |
| Comparative Example 6 | B | C | III |
| Comparative Example 7 | C | C | III |

TABLE 4

| | Low temperature fixing ability | Inhibition of toner spent | Hot offset resistance |
|---|---|---|---|
| Example 7 | A | C | I |
| Example 8 | B | B | I |
| Example 9 | B | B | 1 |
| Example 10 | B | A | I |
| Example 11 | A | B | I |
| Example 12 | A | C | I |
| Example 13 | A | C | II |
| Example 14 | A | C | I |
| Example 15 | B | B | I |
| Example 16 | B | B | I |

TABLE 4-continued

| | Low temperature fixing ability | Inhibition of toner spent | Hot offset resistance |
|---|---|---|---|
| Example 17 | B | A | I |
| Example 18 | A | B | I |
| Example 19 | A | C | I |
| Example 20 | A | C | II |
| Example 21 | A | C | I |
| Example 22 | A | B | I |
| Example 23 | A | B | II |
| Comparative Example 8 | C | D | III |
| Comparative Example 9 | D | C | II |
| Comparative Example 10 | D | C | I |
| Comparative Example 11 | D | D | II |

The evaluation methods of the developers are as described below.

(Low Temperature Fixing Ability in High Temperature High Humidity Environment)

The low temperature fixing ability of the developer was evaluated by forming an image and continuously output 10,000 sheets of a chart having an imaging area of 3% in the environment of 45° C., 80% RH, with varying the temperature of the fixing roller at an interval of 5° C. Specifically, an image was formed on a full-color PPC paper 6200 (manufactured by Ricoh Company Limited) so that the image had an image density of 1.2 as measured by X-Rite 938 (manufactured by X-Rite), and then the image was rubbed with a clock meter equipped with a sand eraser 50 times. The temperature, at which the image had the image density of 70% or higher after the rubbing compared to the image density thereof before the rubbing, was determined as the lowest fixing temperature. Note that, the case where the lowest fixing temperature was lower than that of the imagio MP C6000 (manufactured by Ricoh Company Limited) by 15° C. or more was evaluated as A, the case where the lowest fixing temperature was lower by 5° C. or more, but less than 15° C. was evaluated as B, and the lowest fixing temperature was lower by 0° C. or more, but less than 5° C. was evaluated as C, and the lowest fixing temperature higher than that of the imagio MP C6000 was evaluated as D.

(Inhibition of Toner Spent in High Temperature High Humidity Environment)

After continuously output 100,000 sheets of a chart having an imaging area of 20% in the environment of 45° C., 80% RH, the developer was taken out. The developer was then placed in a cylindrical cage on both ends of which wire netting was provided, and the toner was separated from the developer by high pressure air, to thereby collect only the carrier. After embedding the carrier in a resin, a cut piece having a cross-section of the carrier was prepared using a cross-section polisher IB-09010CP (manufactured by JEOL Ltd.), and the cross-section thereof was observed under a field emission scanning microscope (ULTRA55, of Carl Zeiss MocroImaging Japan) to thereby evaluate inhibition of toner spent. Specifically, 10 carrier particles were randomly selected, and a thickness of the toner spent was analyzed by an image processing software. Note that, the case where no toner spent was observed was evaluated as A, the case where the average thickness of the toner spent was less than 100 nm was evaluated as B, the case where the thickness thereof was 100 nm or more, but less than 200 nm was evaluated as C, and the case where the thickness thereof was 200 nm or more was evaluated as D.

(Hot Offset Resistance in High Temperature High Humidity Environment)

The hot offset resistance of the developer was evaluated by forming an image and continuously output 10,000 sheets of a chart having an imaging area of 3% in the environment of 45° C., 80% RH, with varying the temperature of the fixing roller at an interval of 5° C. Specifically, an image was formed on a full-color PPC paper 6200 (manufactured by Ricoh Company Limited) so that the image had an image density of 1.2 as measured by X-Rite 938 (manufactured by X-Rite), and then the image was visually observed to determine the temperature at which hot offset, i.e., the deposition of the toner on the fixing unit, occurred. Note that, the case where the hot offset occurring temperature was higher than that of the imagio MP C6000 (manufactured by Ricoh Company Limited) by 5° C. or more was evaluated as I, the case where the hot offset occurring temperature was higher by 0° C. or more but less than 5° C. was evaluated as II, and the case where the hot offset occurring temperature was lower than that of the imagio MP C6000 was evaluated as III.

[Evaluation 2 of Developer]

The developer was evaluated by means of a modified device of an image forming apparatus (imagio MP C6000, manufactured by Ricoh Company Limited) the fixing section of which had been modified. Specifically, the system speed was adjusted to 2.2 m/s. Moreover, the fixing unit in the fixing section was adjusted to press the recording medium bearing the transferred toner image at the beating of $1.1\times10^6$ Pa for 0.13 seconds. Note that, as a fixing roller, a roller prepared by applying a tetrafluoroethylene-perfluoroalkylvinyl ether copolymer (PFA) onto a surface of the roller, shaping, and adjusting the surface thereof, was used. Moreover, the heating temperature of the fixing roller was set at 150° C.

The evaluation results of the developer are depicted in Table 5.

TABLE 5

| | Low temperature fixing ability | Inhibition of toner spent | Hot offset resistance |
|---|---|---|---|
| Example 1 | C | C | II |

REFERENCE SIGNS LIST

10 Photoconductor drum
20 Charging roller
24 Transfer belt
25 Fixing device
30 Exposing device
40 Developing device
50 Intermediate transfer belt
60 Cleaning device
70 Diselectrification lamp
80 Transfer roller
100 Image forming apparatus

The invention claimed is:

1. A toner, comprising:

base particles having a core-shell structure, the core comprising a crystalline polyester, a non-crystalline polyester, a colorant, and a releasing agent, and the shell comprising a resin, wherein the toner has a thermal hardness of 0.5 to 1.8, a softening index of 80° C. to 95° C., and a thermal retentiveness of 30° C. to 50° C.

2. The toner according to claim 1, wherein the resin is a vinyl resin or a polyester resin.

3. The toner according to claim 1, wherein the shell has a thickness of 0.01 μm to 2 μm.

4. The toner according to claim 1, wherein the core further comprises a urea-modified polyester.

5. The toner according to claim 4, wherein the base particles are obtained by a method comprising:

dissolving or dispersing the crystalline polyester, the non-crystalline polyester, a polyester prepolymer comprising an isocyanate group, a compound comprising an amino group, the colorant, and the releasing agent in an organic solvent, thereby preparing a liquid;

emulsifying or dispersing the liquid in an aqueous medium comprising particles comprising the resin; and removing the organic solvent.

6. The toner according to claim 1, wherein the toner has an average circularity of 0.93 to 0.99.

7. The toner according to claim 1, wherein the toner has a shape factor SF-1 of 100 to 150 and a shape factor SF-2 of 100 to 140.

8. The toner according to claim 1, wherein the toner has a weight average particle diameter of 2 μm to 7 μm and a ratio of the weight average particle diameter of the toner to a number average particle diameter of the toner of 1.00 to 1.25.

9. A developer, comprising:

a toner comprising base particles; and a carrier, wherein the base particles have a core-shell structure, the core comprising a crystalline polyester, a non-crystalline polyester, a colorant, and a releasing agent, and the shell comprising a resin, and the toner has a thermal hardness of 0.5 to 1.8, a softening index of 80° C. to 95° C., and a thermal retentiveness of 30° C. to 50° C.

10. An image forming method comprising:

forming a plurality of latent electrostatic images on a plurality of latent electrostatic image bearing members;

developing the plurality of latent electrostatic images formed on the plurality of latent electrostatic image bearing members with a developer, thereby forming toner images;

successively transferring the toner images formed on the plurality of latent electrostatic image bearing members onto an intermediate transfer member, thereby forming a full-color toner image;

transferring the full-color toner image formed on the intermediate transfer member onto a recording medium; and pressing and heating the full-color toner image transferred on the recording medium at bearing of $1\times10^5$ Pa to $3\times10^7$ Pa for 0.03 seconds to 0.4 seconds, thereby forming the full-color toner image on the recording medium, wherein the image forming method employs a system speed of 0.2 m/s to 3 m/s, wherein the developer comprises:

a toner comprising base particles; and a carrier, wherein the image forming method is suitable for forming a full color image with a tandem image forming apparatus, the base particles have a core-shell structure, the core comprising a crystalline polyester, a non-crystalline polyester, a colorant, and a releasing agent, and the shell comprising a resin, the toner has a thermal hardness of 0.5 to 1.8, a softening index of 80° C. to 95° C., and a thermal retentiveness of from 30° C. to 50° C.

* * * * *